US008662704B2

(12) United States Patent
Carraher et al.

(10) Patent No.: US 8,662,704 B2
(45) Date of Patent: Mar. 4, 2014

(54) LED OPTICAL SYSTEM WITH MULTIPLE LEVELS OF SECONDARY OPTICS

(75) Inventors: Timothy J. Carraher, Palmdale, CA (US); Lucas C. Peters, Palmdale, CA (US)

(73) Assignee: U.S. Pole Company, Inc., Palmdale, CA (US)

( * ) Notice: Subject to any disclaimer, the term of this patent is extended or adjusted under 35 U.S.C. 154(b) by 314 days.

(21) Appl. No.: 12/851,319

(22) Filed: Aug. 5, 2010

(65) Prior Publication Data

US 2011/0038151 A1 Feb. 17, 2011

Related U.S. Application Data

(60) Provisional application No. 61/234,248, filed on Aug. 14, 2009.

(51) Int. Cl.
*F21V 13/02* (2006.01)
*F21V 13/12* (2006.01)
*F21V 5/02* (2006.01)

(52) U.S. Cl.
USPC ..... 362/242; 362/227; 362/244; 362/249.02

(58) Field of Classification Search
USPC ..... 362/242, 232, 327, 332–336
See application file for complete search history.

(56) References Cited

U.S. PATENT DOCUMENTS 4,254,453 A * 3/1981 Mouyard et al. ..... 362/240
4,935,665 A * 6/1990 Murata ..... 313/500
5,257,336 A 10/1993 Dautartas
6,515,810 B1 2/2003 Melford
6,547,423 B2 * 4/2003 Marshall et al. ..... 362/333
6,654,174 B1 11/2003 Huang
6,799,864 B2 10/2004 Bohler et al.
6,808,293 B2 10/2004 Watanabe et al.
7,281,818 B2 10/2007 You et al.
7,321,161 B2 1/2008 Teixeira et al.
7,348,723 B2 * 3/2008 Yamaguchi et al. ..... 313/501
7,390,097 B2 * 6/2008 Magarill ..... 353/94
7,461,948 B2 12/2008 van Voorst Vader et al.
7,918,583 B2 * 4/2011 Chakmakjian et al. ..... 362/240

(Continued)

OTHER PUBLICATIONS

International Search Report dated Oct. 6, 2010 for International Application No. PCT/US2010/045504, 2 pages.

(Continued)

*Primary Examiner* — Sikha Roy
(74) *Attorney, Agent, or Firm* — Christie, Parker & Hale, LLP

(57) ABSTRACT

An optical system for lighting fixtures uses light emitting diodes arranged in a 2-D array. In one embodiment, a lighting system comprises a framework carrying a plurality of diodes, where each diode has an associated optic that projects the light with a "high," "medium" or "low" vertical throw, as provided by prismatic "teeth" that refract and reflect light rays in a predetermined manner so that the combined illumination patterns of each diode can blend to generally uniformly illuminate a target surface without dark spots or regions. Each optic has a common primary portion and a selected secondary portion whose tooth/teeth have a "swept" geometry for better angular (vertical and/or horizontal) control of light rays. Structural variations between different secondary portions reside in various factors, including plurality of teeth, length of the tooth along the longitudinal axis A, curvature(s) in the vertical and/or horizontal directions, and angularity or tightness of curvature of the swept geometry.

22 Claims, 19 Drawing Sheets

(56) References Cited

U.S. PATENT DOCUMENTS

| | | | | |
|---|---|---|---|---|
| 8,220,958 | B2 * | 7/2012 | Montagne | 362/235 |
| 8,337,054 | B2 * | 12/2012 | Bernard | 362/335 |
| 2003/0112523 | A1 * | 6/2003 | Daniell | 359/626 |
| 2003/0235050 | A1 | 12/2003 | West et al. | |
| 2005/0281029 | A1 * | 12/2005 | Inamoto | 362/234 |
| 2006/0132725 | A1 * | 6/2006 | Terada et al. | 353/102 |
| 2006/0139918 | A1 * | 6/2006 | Dolgin et al. | 362/232 |
| 2007/0139798 | A1 | 6/2007 | Epstein | |
| 2007/0273957 | A1 | 11/2007 | Zalevsky et al. | |
| 2008/0054787 | A1 | 3/2008 | Hwang et al. | |
| 2008/0089062 | A1 * | 4/2008 | Vennetier et al. | 362/241 |
| 2008/0259460 | A1 | 10/2008 | Cummings et al. | |
| 2008/0273327 | A1 * | 11/2008 | Wilcox et al. | 362/267 |
| 2008/0298057 | A1 | 12/2008 | Scordino et al. | |

OTHER PUBLICATIONS

Written Opinion dated Oct. 6, 2010 for International Application No. PCT/US2010/045504, 4 pages.

Philips, Roadstar Series, Brochure, 2009, pp. 1-26, USA.

* cited by examiner

FIG. 4a
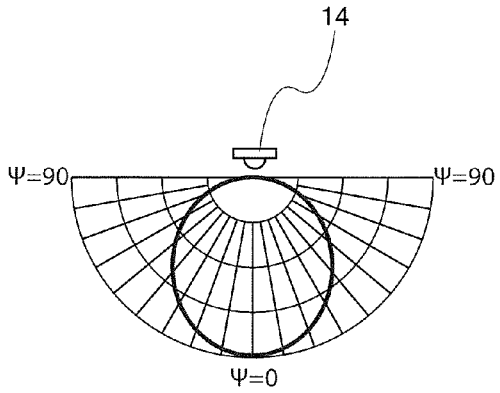
FIG. 4b
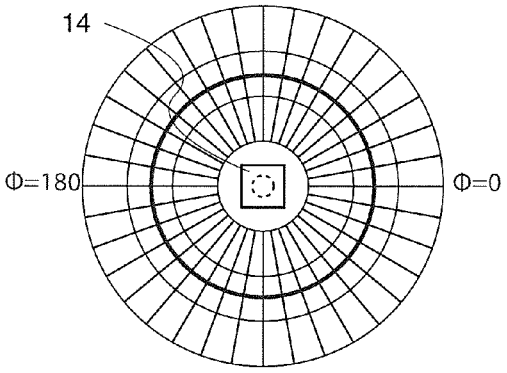
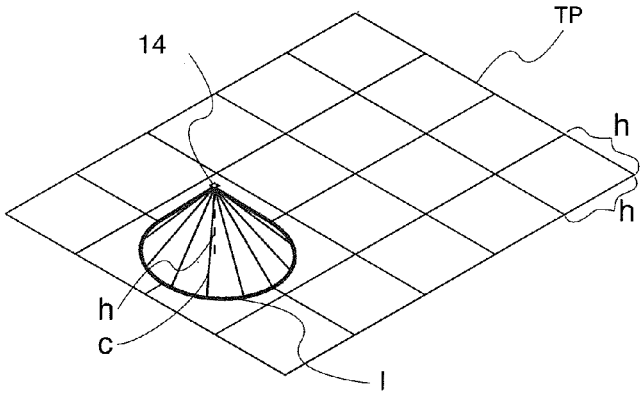
FIG. 4c
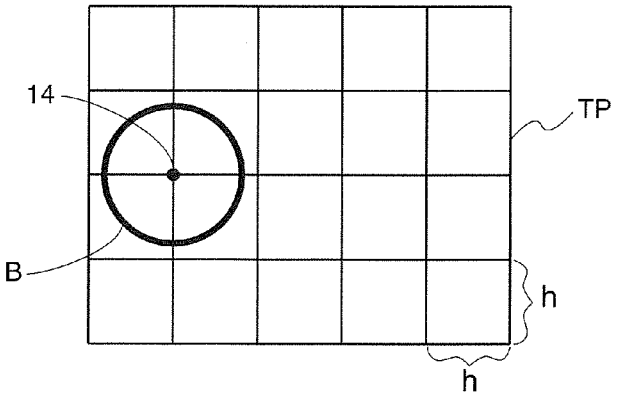
FIG. 4d

FIG. 12a
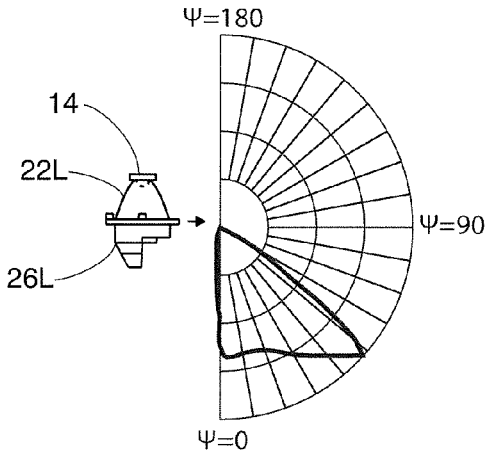
FIG. 12b
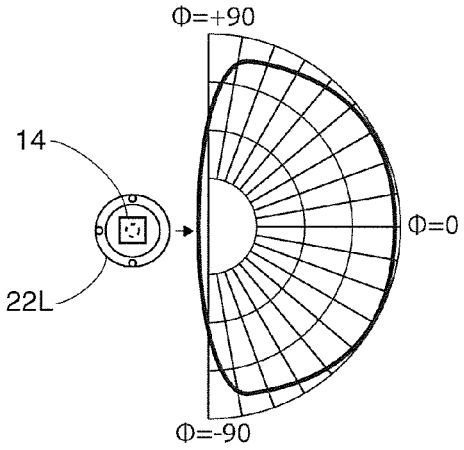
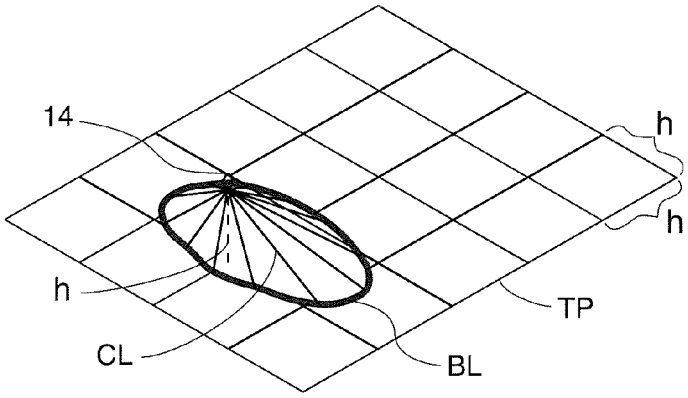
FIG. 12c
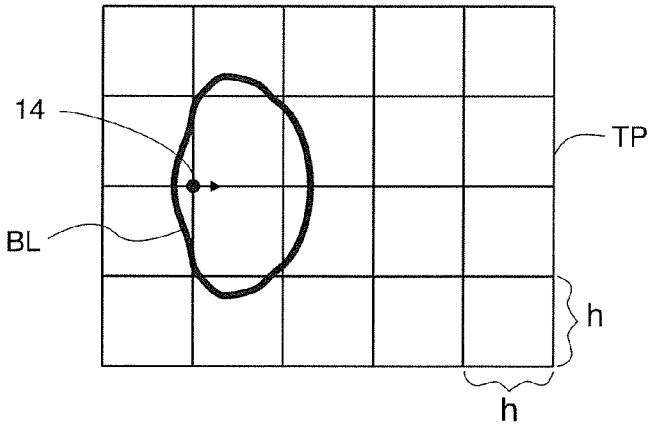
FIG. 12d

FIG. 13a
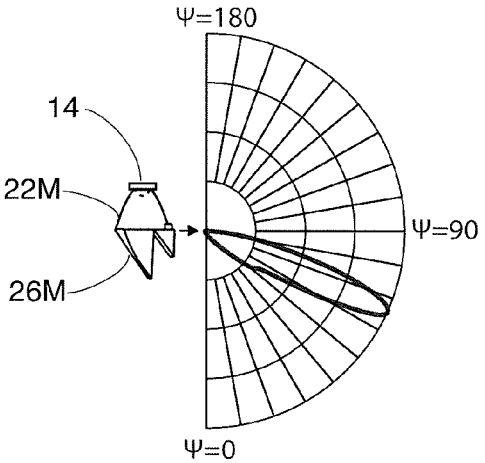
FIG. 13b
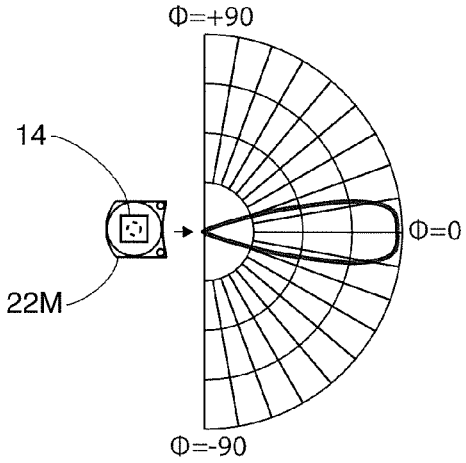
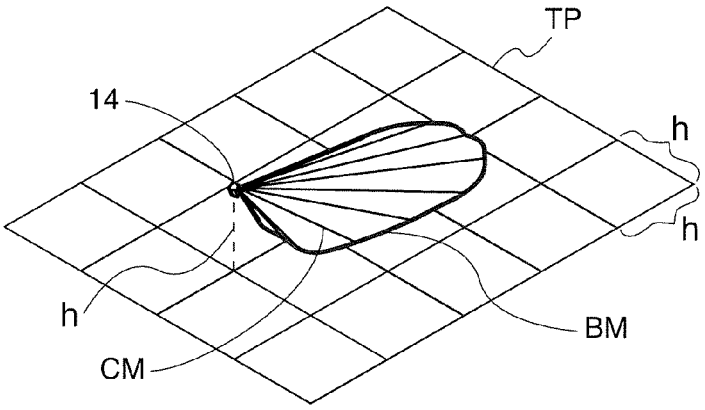
FIG. 13c
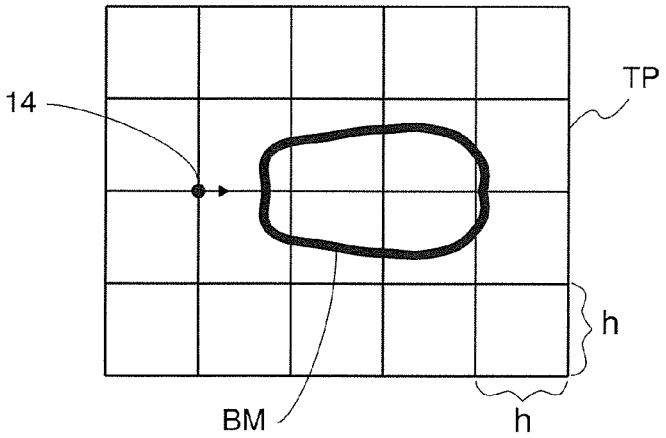
FIG. 13d

FIG. 14a
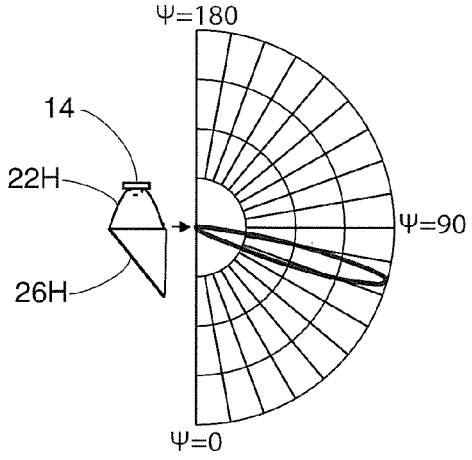
FIG. 14b
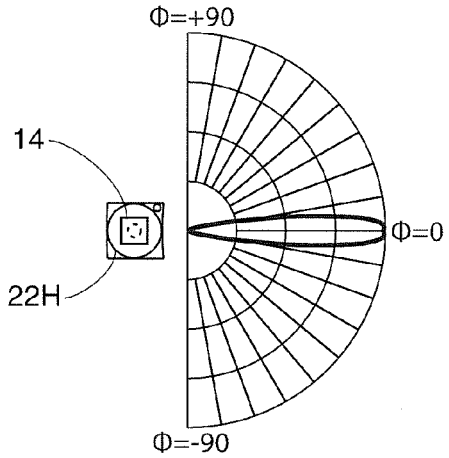
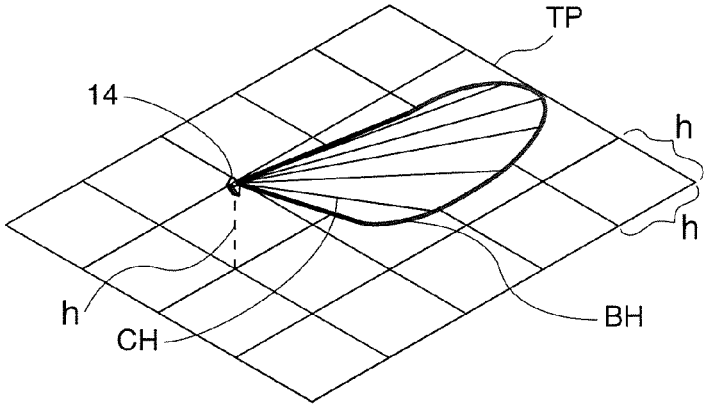
FIG. 14c
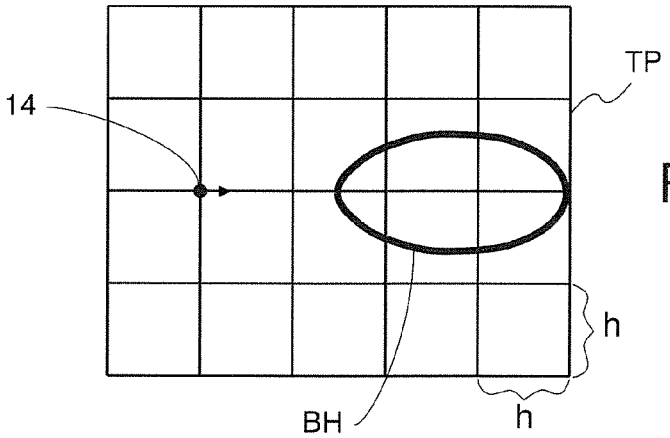
FIG. 14d

FIG. 17a(1)
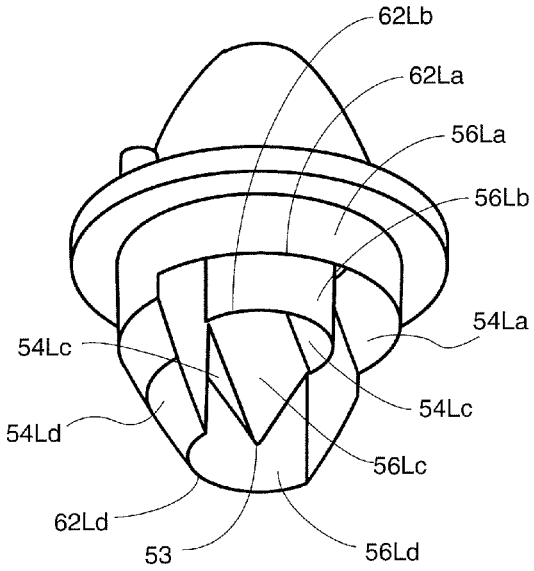
FIG. 17a(2)
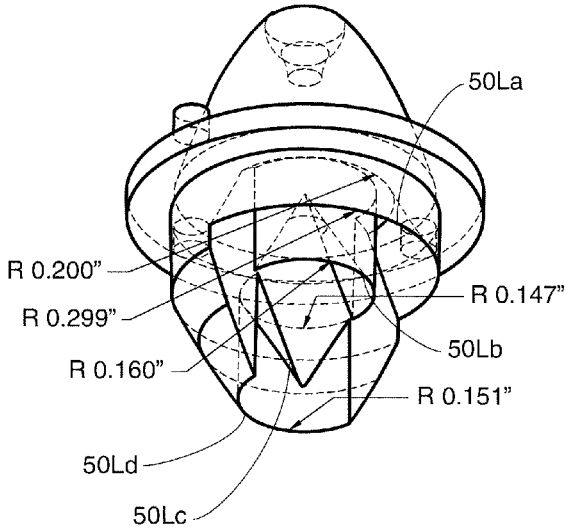
FIG. 17b
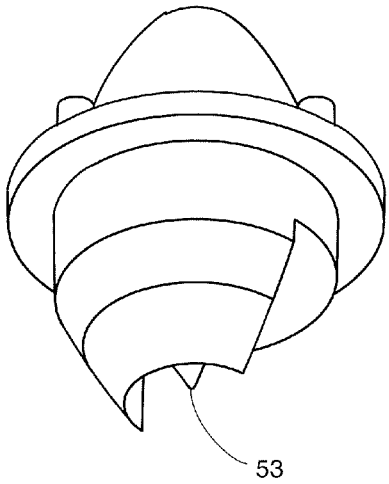
FIG. 17c
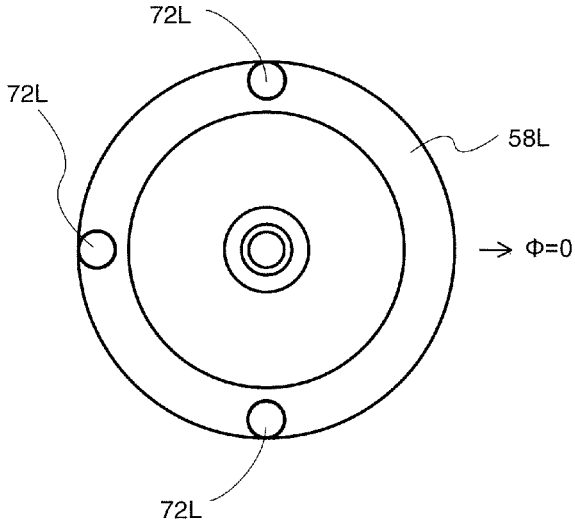

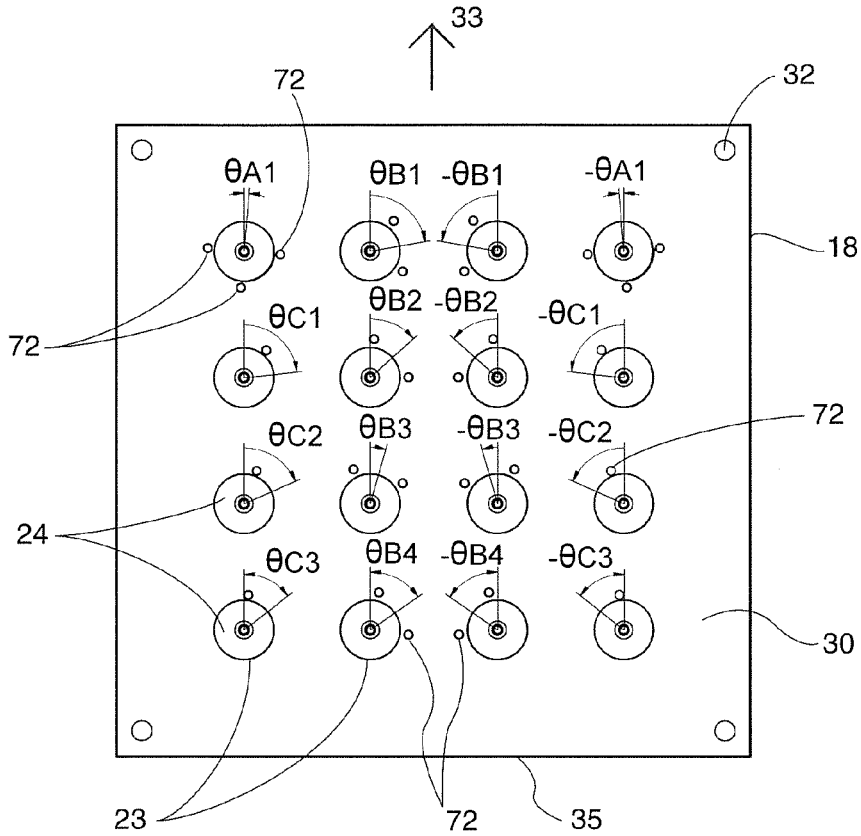
FIG. 18
FIG. 19a
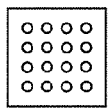
FIG. 19b
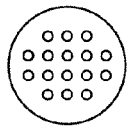
FIG. 19c
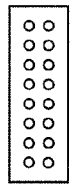
FIG. 19d
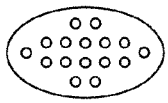
FIG. 19e
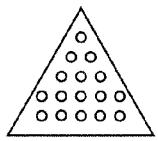
FIG. 19f
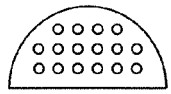
FIG. 19g
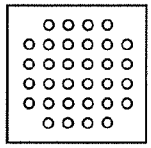
FIG. 19h
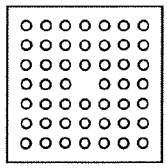
FIG. 19i
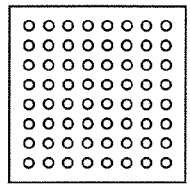

LED OPTICAL SYSTEM WITH MULTIPLE LEVELS OF SECONDARY OPTICS

CROSS-REFERENCE TO RELATED APPLICATIONS

This application claims the benefit of U.S. Provisional Patent Application No. 61/234,248, Aug. 14, 2009, the entire disclosure of which is hereby incorporated by reference.

FIELD OF INVENTION

The present invention relates to lighting systems, in particular lighting systems using light emitting diodes to illuminate a target surface.

BACKGROUND OF INVENTION

A luminaire or light fixture includes at least a light source (or lamp), electrical components and a housing. A standard luminaire for illumination of surfaces, areas or objects typically uses a single light source and may include an optical arrangement to control raw light output from the single light source for more efficient distribution of the light. The optical arrangement can be a lens, a refractor, a reflector, or a combination of these optical elements that controls the light and produces a desired illumination pattern or distribution.

Most standard lamps come in very high wattages and can produce high lumen outputs. Light emitting diodes (LEDs) differ in that they are low wattage but they have increased in efficiency so as to make them practical for use in lighting systems. Previously, these devices were not sufficiently efficacious compared to a standard light source such as fluorescent, high intensity discharge, or incandescent. As with all light sources, the total light output of LEDs requires optical control to make it perform properly and maximize the light coverage over a surface or area.

In order to produce the equivalent amount of light of a high wattage standard lamp source, a large array of LED can be used although LEDs also differ in their raw light output. Most standard lamp sources produce a radial illumination pattern that is generally uniform in all directions and emanates from a single area on or within the lamp such as a filament or arc tube. However, LEDs produce a Lambertian distribution which only emanates from the front of the diodes and is not uniform in all directions. As such, most LEDs have a built-in lens to control the raw light output in a primary fashion, but a primary lens or optic has not proven to provide the necessary optical control to provide illumination patterns that are suitable to replace standard luminaire optical systems and lamp sources.

Problems with direct replacement of standard lamp sources stem from the inability to mimic the emanation of the standard sources raw light output. As notably stated, an array of multiple LEDs must be used to replace a standard light source, where each diode is a point source such that the array of diodes comprises multiple point sources spread over an area within the lighting fixture or luminaire. Individual diodes of the array must also be spaced apart for heat dissipation, a critical aspect of LED system design. Thus, standard optical systems are often useless for LED systems as they are designed around a point source, linear source, or small area source.

Some LED systems may use a secondary-type optic repeated over each individual diode of the LED array. These types of LED systems have not yet proven to exceed the light distributions of standard lamp sources. Typically, their distributions fall short or they have similar amounts of waste light due to only having one level of control used over the LED array.

Thus, it is desirable to provide an LED array with primary optics and multiple levels of secondary optics, where each level of secondary optics can be precisely aimed so that the array provides a more uniform distribution. It is desirable for such an LED array to have a larger, more efficient light distribution and meet or exceed standard type lamp systems. In a practical manner, an LED system with multiple levels of secondary optics would be superior as these secondary optics can be aimed and combined to produce different distribution shapes to more effectively light surfaces or areas.

SUMMARY OF INVENTION

The present invention recognizes principles of illumination with a goal of mimicking the intensity distribution desirable to perfectly or uniformly illuminate surfaces from a luminaire. A "perfect" intensity distribution would see all light emitted from the luminaire become incident on a target plane in a uniform manner. Such a distribution would also generally eliminate all waste light, thereby gaining efficiency through the light distribution produced on the target surface or area. While a "perfect" distribution is virtually impossible to achieve, an ideal or otherwise superior optical system providing high uniformity, maximum light on the target area or surface with minimal waste light is possible.

The present invention relates to an optical system used in lighting fixtures, or luminaires, where light emitting diodes (LEDs) arranged in a 2-D array are multiple sources of light used to illuminate surfaces, areas, or objects. The system efficiently controls raw light distribution or output of each individual LED within the array through the use of optics. The system makes better use of the raw LED light output, directing it more efficiently over a larger area or surface. By using individual LED optical components that are fitted to individual LEDs, raw output of the LEDs are trained by the optics into different patterns. By precisely aiming each individual LED optic and combining their illumination patterns, unique light patterns can be achieved which more efficiently light areas and surfaces than previous methods.

In one embodiment, a lighting system of the present invention comprises a framework carrying a plurality of diodes, where each diode has an associated optic. The optics populating the framework are a selected combination of optics of different levels or categories, for example, the categories of "high," "medium" and "low," where each category is defined by a predetermined range of vertical reflectance angles and a predetermined range of horizontal reflectance angles, as provided by prismatic portion(s) or "teeth" that refract and reflect light rays in a predetermined manner. The ranges of vertical and horizontal reflectance angles of different categories advantageously overlap so that the illumination patterns of different categories can blend to generally uniformly illuminate a target surface without dark spots or regions.

Depending on the category, an optic can have one or more prismatic portion or tooth. In one embodiment, an optic of the "high" category (or "high" optic) has one prismatic portion, an optic of the "medium" category (or "medium" optic) has two prismatic portions, and an optic of the "low" category (or "low" optic) has at least three, if not four, prismatic portions. The high optic has a vertical reflectance angle range of about twenty degrees, between about 60 to 80 degrees measured from nadir, and a horizontal reflectance angle range of about twenty degrees, between about −10 to +10 degrees. The medium optic has a vertical reflectance angle range of about twenty degrees, between about 50 to 70 degrees measured from nadir, and a horizontal reflectance angle range of about forty degrees, between about −20 to +20 degrees. The low optic has a vertical reflectance angle range of about fifty degrees, between about 0 to 50 degrees measured from nadir, and a horizontal reflectance angle range of about one hundred eighty degrees, between about −90 to +90 degrees.

In a detailed embodiment, a lighting system of the present invention includes a first plate member carrying diodes and a second plate member carrying optical members, one for each diode. Each optical member includes a primary optic for collecting and collimating light from its respective diode and a secondary optic for emitting the light within a predetermined range of vertical angles and a predetermined range of horizontal angles in accordance with the category of high, medium or low of the secondary optic. Moreover, each optical member has alignment members or indicia that provide information and/or enable alignment and positioning of the optical member on the second plate member.

In a more detailed embodiment, each secondary optic has at least one prismatic portion or "tooth", where each tooth has a rear (or reflective) surface that reflects collimated light rays which exit the optic from a front (or exiting) surface toward a target surface. Each tooth has a "swept" geometry for better angular (vertical and/or horizontal) control of light rays, where structural variations between teeth of different categories of secondary optics reside in various factors, including plurality of teeth, length of the tooth along the longitudinal axis A, curvature(s) in the vertical and/or horizontal directions, and angularity or tightness of curvature of the swept geometry. To that end, the front or rear surfaces of each tooth can be curved, with selected teeth having surfaces with curvature in more than one direction and/or multiple curvatures in any one direction. These curvatures serve to reflect and direct the light out of the tooth in different spatial distributions, where a milder, more open curvature provides a narrower distribution and a stronger, tighter curvature provides a wider distribution. These curvatures can control the exiting light in both the horizontal and/or vertical directions and the length of a tooth is predetermined to avoid light ray occlusion by adjacent optical members.

BRIEF DESCRIPTION OF THE DRAWINGS

These and other features and advantages of the present invention will be better understood by reference to the following detailed description when considered in conjunction with the accompanying drawings wherein:

FIG. 4*a* is a vertical polar plot of illuminance intensity of a diode.

FIG. 4*b* is a horizontal polar plot of illuminance intensity of a diode.

FIG. 4*c* is a isometric 3-D graph of a cone of constant illuminance of a diode.

FIG. 4*d* is a 2-D graph of a base of the cone of FIG. 4*c*.

FIG. 12*a* is a vertical polar plot of illuminance intensity of a diode equipped with a low optical member of FIG. 10*c*.

FIG. 12*b* is a horizontal polar plot of illuminance intensity of the equipped diode of FIG. 12*a*.

FIG. 12*c* is a isometric 3-D graph of a cone of constant illuminance of the equipped diode of FIG. 12*a*.

FIG. 12*d* is a 2-D graph of a base of the cone of FIG. 12*c*.

FIG. 13*a* is a vertical polar plot of illuminance intensity of a diode equipped with a medium optical member of FIG. 10*b*.

FIG. 13*b* is a horizontal polar plot of illuminance intensity of the equipped diode of FIG. 13*a*.

FIG. 13*c* is a isometric 3-D graph of a cone of constant illuminance of the equipped diode of FIG. 13*a*.

FIG. 13*d* is a 2-D graph of a base of the cone of FIG. 13*c*.

FIG. 14*a* is a vertical polar plot of illuminance intensity of a diode equipped with a high optical member of FIG. 10*a*.

FIG. 14*b* is a horizontal polar plot of illuminance intensity of the equipped diode of FIG. 14*a*.

FIG. 14*c* is a isometric 3-D graph of a cone of constant illuminance of the equipped diode of FIG. 14*a*.

FIG. 14*d* is a 2-D graph of a base of the cone of FIG. 14*c*.

FIG. 17*a*(1) is a front isometric view of an embodiment of a "low" optical member in accordance with the present invention.

FIG. 17*a*(1) is a front isometric view of the "low" optical member of FIG. 17*a*(1), with hidden lines.

FIG. 17*b* is a rear isometric view of the "low" optical member of FIG. 17*a*.

FIG. 17*c* is a top plan view of the "low" optical member of FIG. 17*a*.

FIG. 18 is a top plan view of LED optical system of FIG. 5.

FIGS. 19*a*-19*i* are various embodiments of an LED plate of the present invention.

DETAILED DESCRIPTION OF THE INVENTION

Figure 1:
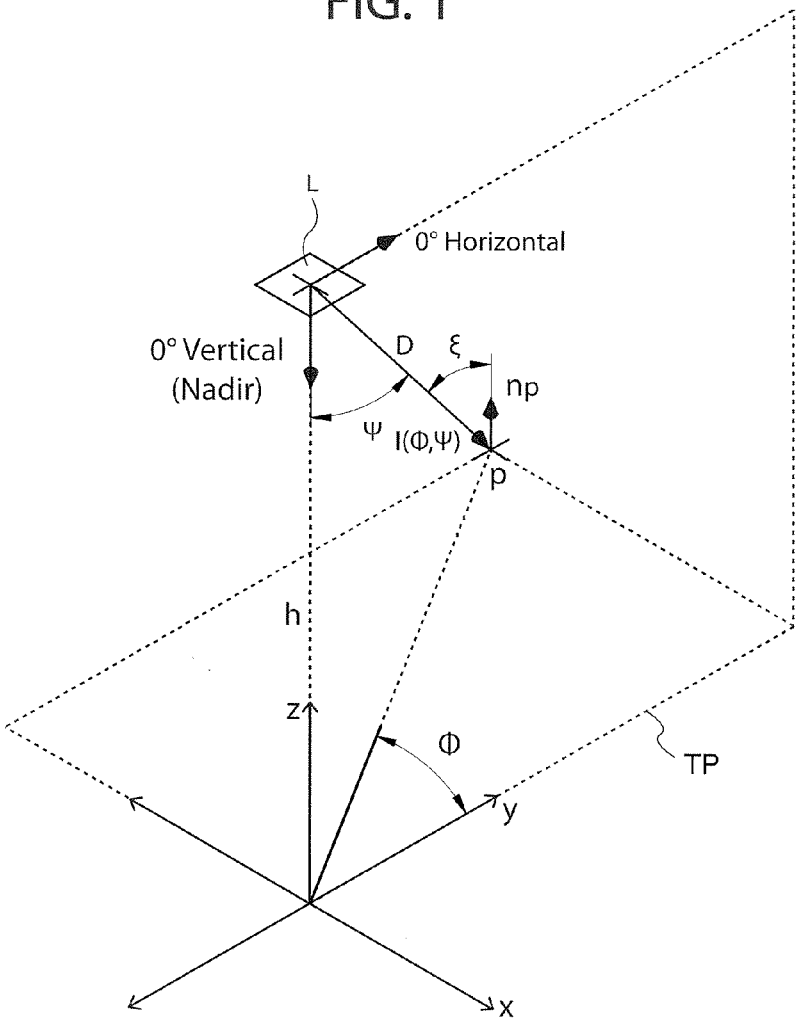
FIG. 1. is a schematic of a light source providing illumination at point P on a target surface.

With reference to FIG. 1, the present invention aims to create a perfect intensity distribution by starting with the following equation for illuminance Ep at point P, where the point or location P is on target area or surface TP (x-y plane) illuminated by a light source or Luminaire L a distance h above (or away from the source) along z axis (or Nadir).

$$Ep=I(\Phi,\Psi)*\cos(\xi)/D^2 \quad \text{Eqn (1)}$$

where P=point or location on x-y plane $n_p$=normal to point P on x-y plane h=vertical distance along z axis from luminaire L to target (x-y) plane containing point P (in ft)

D=distance from luminaire to point P (in ft)

Φ=lateral angle from 0° Hz (y-axis) to point P (in ft)

Ψ=vertical angle from Nadir to point P (in ft)

I(Φ,Ψ)=intensity of luminaire L in direction of point P (in Candela or Cd)

ξ=angle between $n_p$ and I(Φ,Ψ) or the incidence angle

Ep=Illuminance at point P (in Footcandles or FC)

For simplicity sake, it is assumed that the target plane TP and luminaire L are parallel (their normals are parallel, but in opposite directions). With ξ=ψ, Equation (1) for Illuminance at any point on the target plane TP simplifies to:

$$Ep=I(\Phi,\Psi)*\cos(\Psi)/D^2 \quad \text{Eqn (2)}$$

Figure 2:
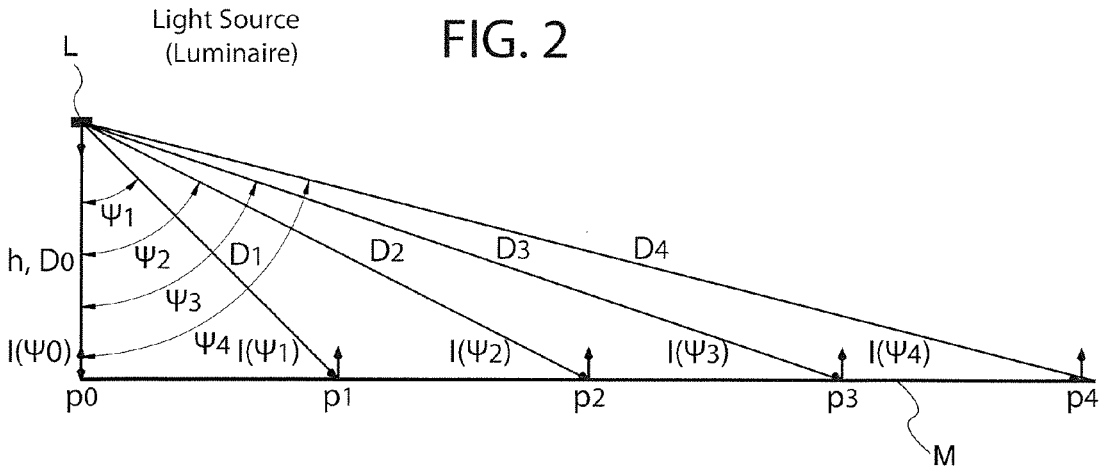
FIG. 2 is a schematic of the light source of FIG. 1 providing illumination to a plurality of points on a target surface.

Expanding from Illuminance at one point P to a plurality of points P0-P4 along a line M of constant illuminance in any radial direction away from the luminaire L (holding horizontal angle Φ constant), only the vertical angle Ψ is varying, as shown in FIG. 2. Equation (2) then simplifies to the following Illuminance at any point along the line to:

$$Ep=I(\Psi)*\cos(\Psi)/D^2 \quad \text{Eqn (3)}$$

The equation can be further simplified by solving for D as a function of h and Ψ, namely, D=h/cos(ψ), and solved for the Intensity (as shown in FIG. 2) to:

$$Ep=I(\Psi)*\cos^3(\Psi)/h^2 \quad \text{Eqn (4)}$$

Thus, the equation for the intensity the luminaire L needs to produce as a function of the distance from the line M to the luminaire L, the desired illuminance at any point along the line M, and the vertical angle is:

$$I(\Psi)=Ep*h^2/\cos^3(\Psi) \quad \text{Eqn (5)}$$

Figure 3:
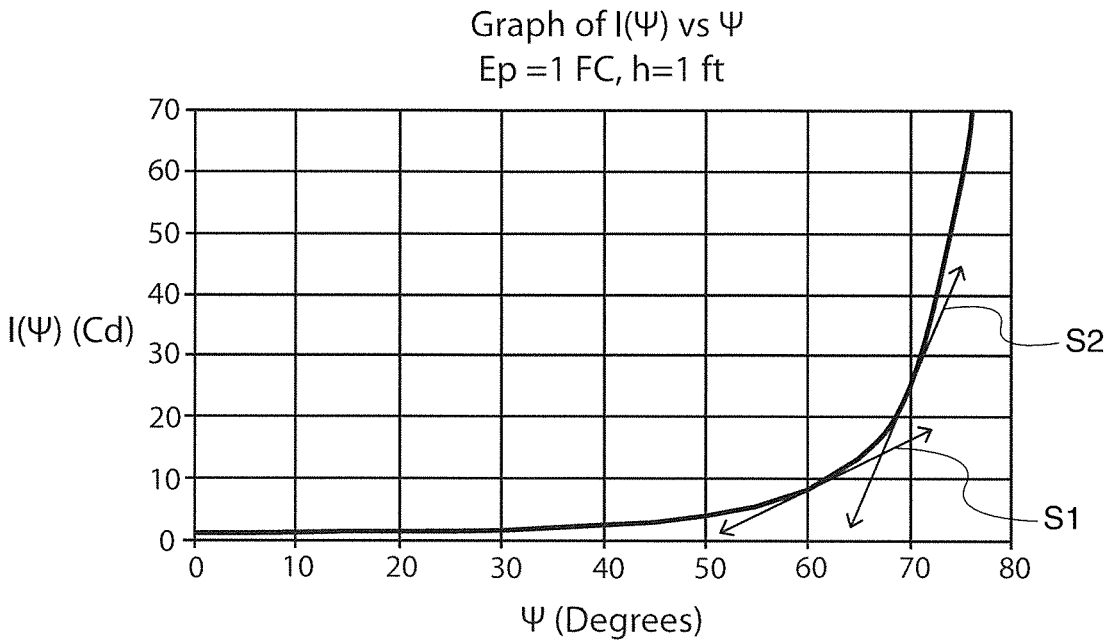
FIG. 3 is a graph showing intensity I of a luminaire in units of candela versus vertical angle ψ in units of feet.

Equation (5) shows that the intensity I required is directly proportional to the inverse of the cosine cubed of the vertical angle. By setting a constant mounting height h and constant illuminance along the line M, a graph of I(Ψ) vs Ψ of FIG. 3 shows an ideal intensity distribution requirement at any vertical angle. This graph shows that:

(1) for vertical angle ψ ranging between about 0 to 50 degrees, the intensity required is relatively constant.

(2) for vertical angle ψ ranging between about 50 to 65 degrees, the intensity can be approximated as a line with slope S1.

(3) for vertical angle ψ ranging between about 65 to about 75 degrees, the intensity can also be approximated as a line with slope S2.

(4) for vertical angle ψ greater than about 75 degrees, the intensity requirement changes very rapidly and becomes asymptotic.

With reference to the vertical polar plot of FIG. 4*a*, for a diode 14 pointing downwardly, or at Nadir (ψ=0), the intensity is strongest directly below the diode and follows a cosine type falloff as the vertical angle ψ goes to 90 degrees. However, these intensities are equal in all directions laterally (Φ ranging from 0 to 360 degrees) as shown in the horizontal polar plot of FIG. 4*b*. If used to illuminate the target surface TP below, the diode 14 emits a 3-dimensional, radially symmetrical volume or of constant illuminance C (with normal height h), as shown in isometric view of FIG. 4*c*, and a constant iso-illuminance line or base B in a configuration of a circle, as shown in the plan view of FIG. 4*d*, where a target plane grid TP is illustrated with a spacing grid equal to the normal height h. In the illustrated embodiment of FIG. 4*d*, the area of the base B spans less than four squares on the target grid TP.

Instead of utilizing a plurality of diodes positioned at different locations over the target surface which would not be as practical in constructing a lighting structure or luminaire, the present invention advantageously controls light from one location over the target and illuminates the target surface from that location, using optical members, each comprising a primary optic and a secondary optic, designed to control total light output of each diode. In accordance with the present invention, different categories or types of secondary optics are used to apply optical properties of the underlying construction material and incorporate different specialized geometries that train the raw LED distribution into a more useful one.

From a practical standpoint, gaining the necessary intensities for vertical angle ψ above 75 degrees is difficult, if not nearly impossible, and it is common practice that optical systems built for area and surface illumination have maximum vertical intensities in about the 70 to 80 degree range. The present invention advantageously considers several practical limitations in providing an optical system that mimics the perfect intensity distribution. First, the present invention accounts for the practical limit of vertical intensity and thus has a maximum intensity in about the 70 degree range. Second, the present invention while not achieving perfect uniformity nonetheless provides a high degree of uniformity that is practical and virtually indistinguishable visually. Lastly, the present invention uses arrangements of primary and various types of secondary optics with each diode to better mimic the perfect intensity distribution.

Figure 5:
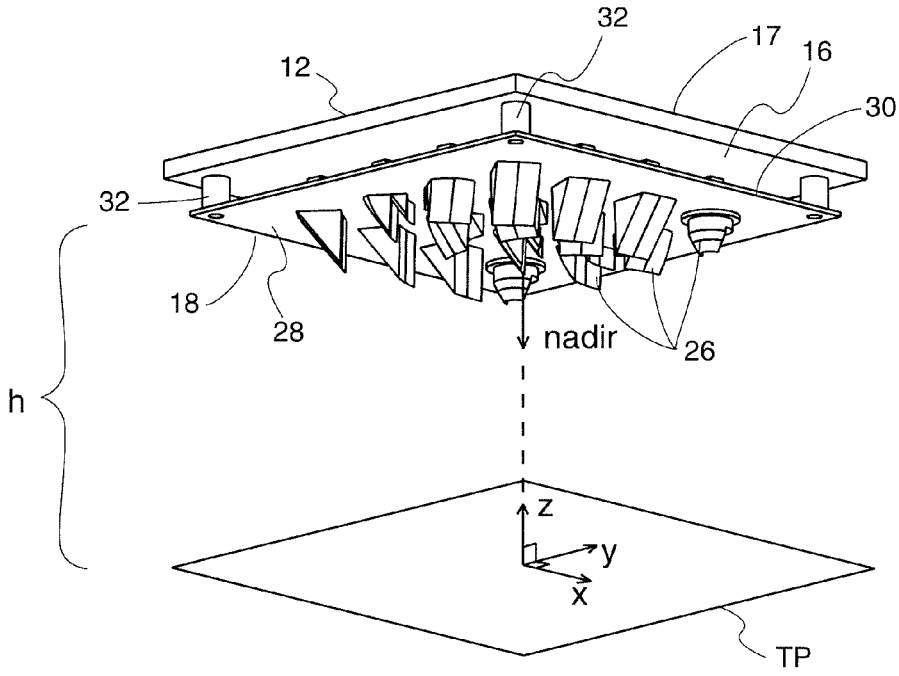
FIG. 5 is a perspective view of an embodiment of an LED optical system in accordance with the present invention.
Figure 6:
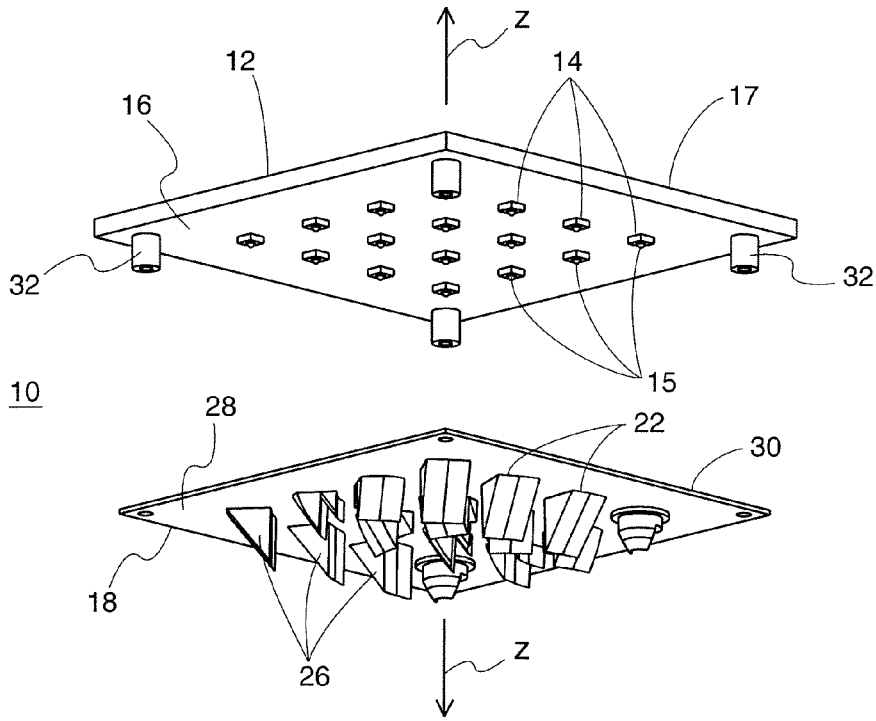
FIG. 6 is a partially-exploded view of the LED optical system of FIG. 5.

With reference to FIG. 5, an embodiment of an LED optical system 10 of the present invention is illustrated illuminating a target surface or area TP defined by at least two dimensions (planar, nonplanar, curved or otherwise), where the system 10 is positioned a distance h from the target surface TP, as measured perpendicularly along a vertical axis. In the illustrations, the system 10 is positioned to direct its illumination downwardly. However, it is understood that terms of direction or orientation (such as vertical, horizontal, up and down, front, back, forward, rearward, etc.) as used herein are merely in reference to the Figures and thus do not limit the present invention and system or use thereof to any specific direction or orientation. With reference to FIGS. 5-9, the system 10 has a support framework including an LED plate member 12 and an alignment plate member 18. The LED plate or array 12 is populated with a plurality of LED diodes 14 ("diodes" hereinafter), each occupying a unique position in the two dimensional plane of the LED plate. The plurality of diodes can range between about 16 to 240, preferably 64 to 120, and more preferably 30 to 120. Each diode 14 has an emitting surface 15 from which light emits from the diode and the LED plate 12 has a forward surface 16 on which all emitting surfaces 15 of the diodes are visible. Thus, light from the diodes effectively emits from the forward surface 16 of the LED plate 12 that is directed toward the target surface TP. The LED plate 12 also has a rearward surface 17 which faces away from the target surface. Typically, circuit boards and wiring are also included in an LED optical system as they are understood to be basic components of an LED array 12.

Figure 7:
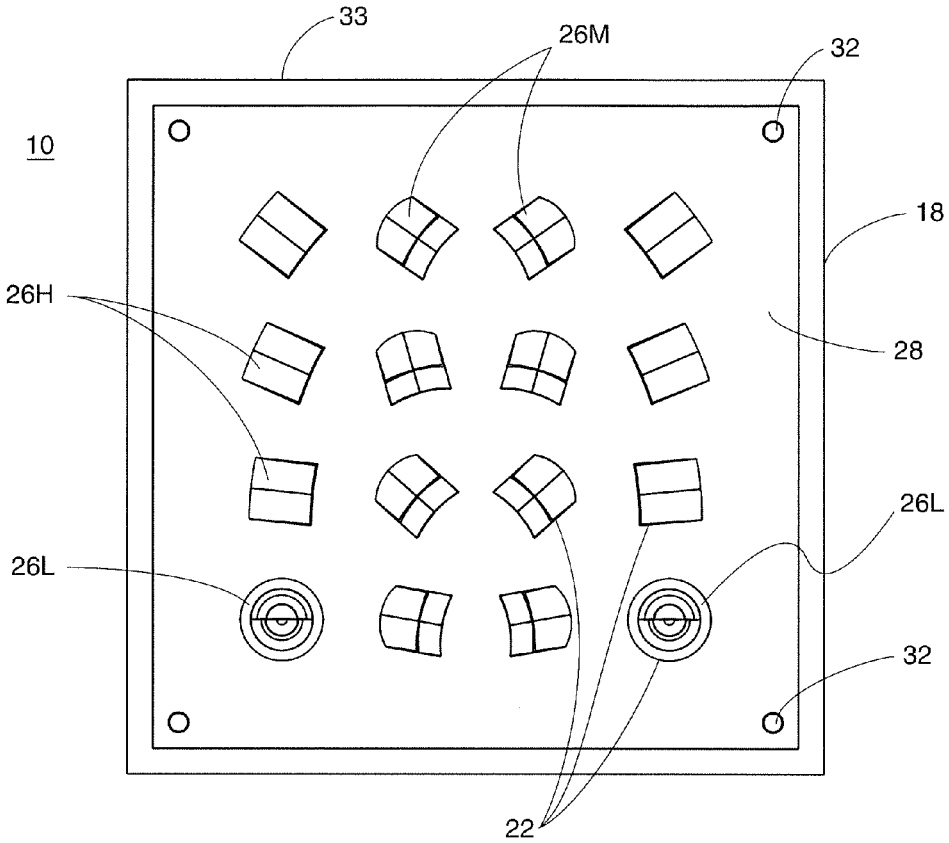
FIG. 7 is a bottom view of the LED optical system of FIG. 5.
Figure 8:
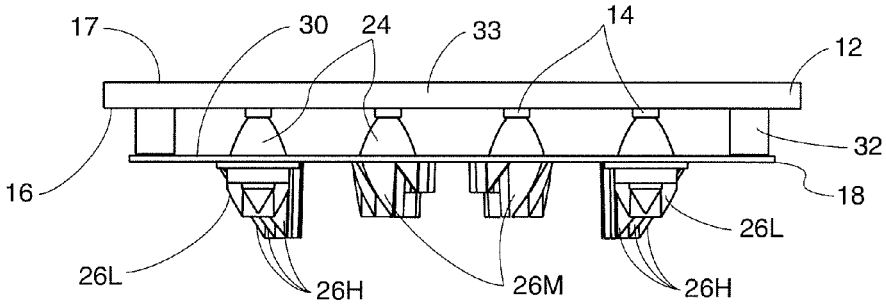
FIG. 8 is a front elevational view of the LED optical system of FIG. 5.
Figure 9:
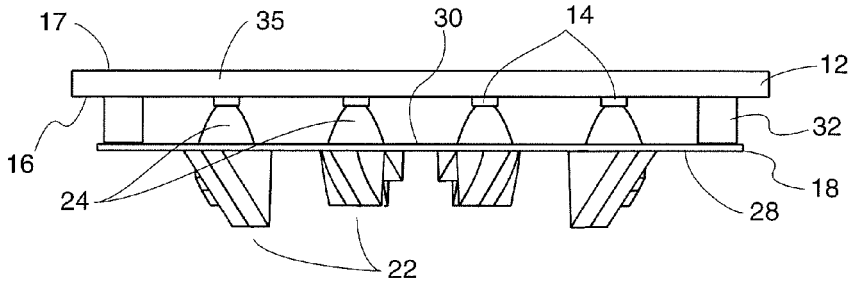
FIG. 9 is a rear elevational view of the LED optical system of FIG. 5.

In the illustrated embodiment of FIGS. 7-9, the emitting face 15 of the diodes 14 and the forward face 16 of the LED plate 12 are directed downwardly toward the optics alignment plate 18 in linear or at least optical alignment with the LED plate 12 along the vertical axis. The alignment plate 18 has mounted thereon a plurality of optical member or optics 22, each of which is received and mounted in an opening or through-hole that corresponds or is associated with a different diode 14 on the LED plate 12. In accordance with a feature of the present invention, each optical member 22 has a primary optic 24 and a secondary optic 26, where the primary optic 24 is of a common configuration for all optical members but the secondary optic 26 is a configuration selected from various different configurations or "types" depending on the range of refraction/reflection angle(s) (vertical and/or horizontal) desirable for a respective diode 14 on the LED plate 12. The alignment plate 18 has a forward surface 28 on which all of the secondary optics 26 are visible, and a rearward surface 30 on which all of the primary optics 24 are visible.

The LED plate 12 and the alignment plate 18 are mounted to each other in a stacked configuration with the forward surface 16 of the LED plate and the rearward surface 30 of the alignment plate 18 facing inwardly toward each other. The forward surface 28 of the alignment plate 18, like the forward surface 16 of LED plate 12, faces the target surface TP. Although the LED and the alignment plates 16 and 18 are illustrated with a similar size and configuration (e.g., a rectangular or square configuration), it is understood that the plates may assume any configuration, such as a round, circular or polygonal configuration, and can have similar or different configurations from each other, so long as each diode 14 on the LED plate 12 is provided if not aligned with a respective optical member 22 on the alignment plate 18 such that light from the diode enters its respective optical member. The plates 12 and 18 are positioned proximately to each other such that most if not all of the light emitting from the diodes 14 enters the optical members 22. Mechanical attachments, such as pins, screws and the like 32, can be used in a peripheral region of the plates to affix the plates to each other. It is understood that the diodes 14 and the optical members 22 can be optically coupled by direct contact with each other, as illustrated, or by other means, including light transmitters, such as light wave guides, fiber optics and the like.

Figure 10A:
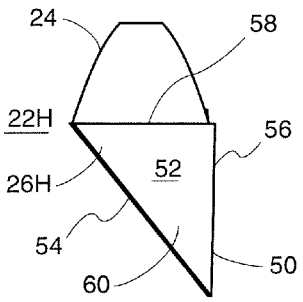
FIG. 10*a* is a side elevational view of an embodiment of a "high" optical member in accordance with the present invention.
Figure 10B:
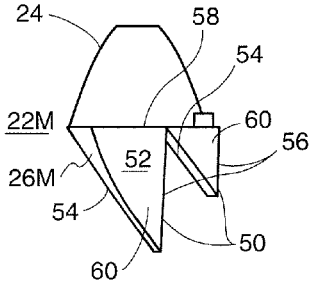
FIG. 10*b* is a side elevational view of an embodiment of a "medium" optical member in accordance with the present invention.
Figure 10C:
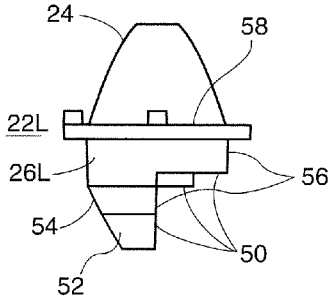
FIG. 10*c* is a side elevational view of an embodiment of a "low" optical member in accordance with the present invention.

The alignment plate 18 is populated with a variety of optical members 22, each having a primary optic 24 and a secondary optic 26. Disclosed embodiments of the optical members are shown in FIGS. 10*a*-10*c*. The present invention applies principles of refraction and reflection, including Total Internal Reflection (TIR) specific to light transmitting optical materials. Suitable materials for constructing the optical members include acrylic, polycarbonate, and glass, which exhibit refraction and total internal reflection (TIR). And by providing different shapes, profiles and/or contours (the terms "shape", "profile" and "contour" used interchangeably herein), predetermined placement of outfitted diodes 14 in terms of their position and alignment angle within the LED array 12 controls the raw light distribution of the diodes and re-emits their light as a more useful distribution specific to illumination tasks. In that regard, the unique shapes of optical members 22 stem from the TIR and "critical angle" of the construction material(s). In the disclosed embodiment, the unique shapes were derived from precise calculations and measurements of the TIR and critical angle of optical grade acrylic.

Primary control of a diode's raw light distribution is gained through the primary optic or collimator 24, as illustrated in FIGS. 11*a*-11*d*. The collimator 24 collects light rays 31 emitted from a diode represented by focus F and turns them into a beam of parallel light rays 33 that exits the collimator 24. In the illustrated embodiment, the collimator 24 has a generally solid, radially symmetrical body 40 with an outer surface 42 defining a parabolic shape between a smaller (upper) end 44 and a larger (lower) end 46. The larger or exit end 46 is defined by a larger circular cross-section 57. At the smaller end 44, an entry well or recess 48 is provided in which an emitting surface of the diode is received. The recess 48 has a circular opening 49 centered about the focus F which represents the location at which light from the diode enters the collimator. The focus F lies on a longitudinal axis A of the collimator 24 and of the optical member 22. The recess 48 is radially symmetrical about the axis A, with two portions 41 and 43 defined by a double-curved profile. In the illustrated embodiment, the first portion 41 is adjacent the opening 49 having a generally larger diameter defined by a concave circumferential surface concentric with the focus F, and the second portion 43 has a generally smaller diameter defined by a convex circumferential surface. A bottom 50 of the recess 48 is defined by a convex curvature.

Figure 11A:
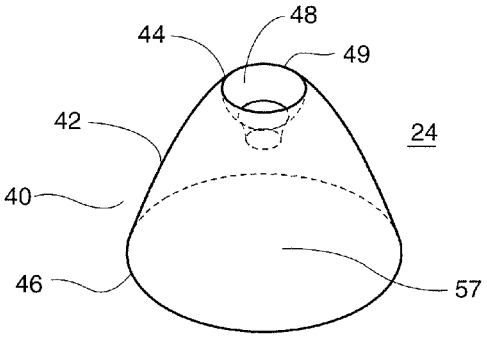
FIG. 11*a* is a isometric view of an embodiment of a primary optic in accordance with the present invention.
Figure 11B:
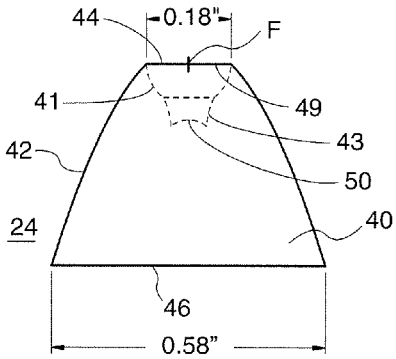
FIG. 11*b* is a side cross-sectional view of the primary optic of FIG. 11*a*.
Figure 11C:
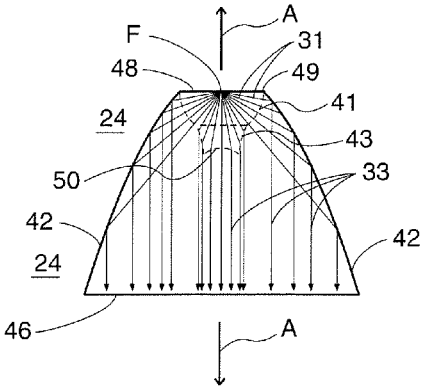
FIG. 11*c* is a side elevational view of the primary optic of FIG. 11*a* illustrating collimation of light rays.
Figure 11D:
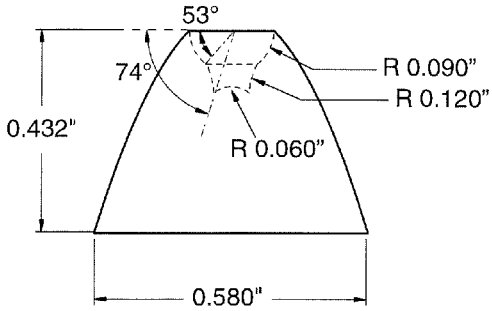
FIG. 11*d* is a side elevational view of the primary optic of FIG. 11*a*.

As shown in FIG. 11*c*, light rays 31 are refracted when they enter the body 40 of the collimator 24 via the first portion 41, the second portion 43 and the bottom 50. Those light rays entering via the second portion 43 and the bottom 50 are refracted toward secondary optic portion 26, whereas those light rays entering via the first portion 41 are incident on the surface 42 and then reflected by means of TIR toward the secondary optic portion 26. Both sets of light rays are formed into a beam of parallel light rays 33 that enter the secondary optic portion 26. Thus, all of the light rays emanating from the focus F are made parallel to the longitudinal axis A within the collimator 24. While they are not evenly dispersed or spaced, the rays 33 exit the collimator 24 generally parallel to each other. In one embodiment, the collimator 24 has a length along the axis A of about 0.432 inches, a recess opening 48 diameter of about 0.180 inches, a radius of about 0.054 at the junction of the portions 41 and 43, a bottom 50 radius of about 0.038", and a circular cross section 57 radius of about 0.300 inches. Other dimensions of the illustrated embodiment of the collimator are shown in FIG. 11*d*, including curvature radii for the concave and convex circumferential surfaces of portions 41 and 43 and for the bottom 50.

The primary optic or collimator 24 allows the diode light to be better manipulated through the secondary optic 26. In accordance with the present invention, the secondary optic 26 can assume different shapes associated with different types or categories, including at least 26H, 26M, 26L, which provide different angular ranges, for example, the aforementioned "low," "medium" and "high" ranges of vertical and horizontal angles. FIGS. 10*a*-10*c* illustrate embodiments of these types. Each type of secondary optic is shaped to provide a different set of secondary control over the diode light rays. Whereas the high type 26H of FIG. 10*a* has a single prismatic tooth, the medium and low types 26M and 26L have at least two prismatic teeth. Again, for each diode within the LED array and its respective optical member, the collimator is generally identical, but the secondary optic varies depending on the angular control that is desired or needed for the light rays of that diode.

As seen in FIGS. 5, 8 and 9, each optical member 22 has a primary optic 24 (of an identical design) that is situated between the plates 12 and 18, and a secondary optic 26 that is exposed on the forward surface 28 of the alignment plate 18 to face the target surface. The different types of secondary optics are visually distinguishable on the forward surface 28, as seen in FIG. 7. In the illustrated embodiments, three types of secondary optics 26H, 26M and 26L are selected for placement on the alignment plate 18 depending on the desired illumination pattern to be achieved on the target surface. The system 10 itself can have a front 33 and a rear 35 especially where the system is positioned off center above the target surface and closer to a peripheral region of the target surface (see, for example, FIGS. 21*a*, 21*c*, 21*d*, 21*e* and 21*h*).

The types of secondary optics, as discussed in detail further below, are distinguished by their respective distinctive geometry which provide different horizontal and vertical distributions. An optical member 22L having a "low-type" or "low" secondary optic 26L (FIG. 10*c*) provides a diode with a low vertical throw (where ψ ranges from, e.g., about 0 to 50 degrees) with a wide horizontal spread (where Φ ranges from, e.g., about −90 to +90, spanning about 180 degrees) as shown in the vertical and horizontal polar plots of FIGS. 12*a*-12*b*. The volume or cone of iso-illuminance $C_L$ of the disclosed embodiment of the secondary optic 26L has a 3-dimensional shape resembling a semi-conical configuration (FIG. 12*c*). In the illustrated embodiment, the base or iso-illuminance line $B_L$ (FIG. 12*d*) is generally a curvilinear polygon resembling an irregular salinon (a geometrical figure with a plurality of semi-circles, e.g., at least four to six convex semi-circles), and the area of the base BL spans about 2.5 squares on the target grid TP, where the width is about 2.4 h, and the depth is about 1.4 h.

An optical member 22M having a "medium-type" or "medium" secondary optic 26M (FIG. 10*b*) provides a diode with a more concise beam with a higher vertical throw (where ψ ranges from, e.g., about 50 to 70 degrees) and a narrower horizontal throw (where Φ ranges between, e.g., about −20 to +20 degrees, spanning about 40 degrees) as shown in the vertical and horizontal polar plots of FIGS. 13*a* and 13*b*. The cone of iso-illuminance $C_M$ of the disclosed embodiment of the secondary optic 26M has a 3-dimensional shape resembling a scallop shell configuration (FIG. 13*c*). In the illustrated embodiment, the base or iso-illuminance line $B_M$ (FIG. 13*d*) is generally a curvilinear polygon resembling a double cardioid (a geometrical figure with a two opposing cusps), and the area of the base $B_M$ spans nearly 4.0 squares on the target grid TP. Advantageously, the "medium" secondary optic is projecting more light away from directly below its position such that the diode 14 is outside of the base $B_M$ by a lateral distance. In the illustrated embodiment, the lateral distance is about 0.75 h, where the width is about 1.2 h and the depth is about 2.2 h.

An optical member 22H with a "high-type" or "high" secondary optic 26H (FIG. 10*a*) provides a diode with an even higher vertical throw (where ψ ranges from, e.g., about 60 to 80 degrees and has a even narrower horizontal beam (where Φ ranges between, e.g., about −10 to +10 degrees, spanning about 20 degrees) as shown in the vertical and horizontal polar plots of FIGS. 14*a*-14*b*. The cone of iso-illuminance $C_H$ of the disclosed embodiment of the secondary optic 26H has a 3-dimensional shape resembling a flattened scallop shell configuration (FIG. 14*c*). In the illustrated embodiment, the base or iso-illuminance line $B_H$ (FIG. 14*d*) is generally an oval, and the area of the base $B_H$ spans nearly 4 squares on the target grid TP. Advantageously, the "high" secondary optic projects light even further way from directly below its position, such that the diode 14 is outside of the base $B_H$ by a lateral distance. In the illustrated embodiment, the lateral distance is about 1.5 h, where the width is about 1.2 h and the depth is about 2.5 h.

It is understood that the intensities shown in the polar plots of FIGS. 12*a*, 12*b*, 13*a*, 13*b*, 14*a* and 14*b* are scaled. The further away the iso-illuminance line is, the higher the intensity is needed to produce a similar illuminance level on the target surface. In the disclosed embodiment, the "medium" secondary optic 26M produces a maximum intensity about 10 times greater than the "low" secondary optic 26L. The "high" secondary optic 26H produces a maximum intensity about three times greater than the "medium" secondary optic 26M and about 30 times greater than the "low" secondary optic 26L.

As the present system uses a plurality of individual diodes, each diode 14 is outfitted with a selected optical member 22 such that the system 10 can use any appropriate mix or combination of the different types of secondary optics 26H, 26M, 26L, and each outfitted diode 14 has a unique alignment angle and position relative to the alignment plate 18 and the target surface TP within the optical system 10. The outfitted diodes (namely, diodes 14 with their respective optical members 22) within the system work in concert to produce highly efficient distributions which overlap and blend to avoid the appearance of darker areas. The system can be varied in terms of various factors, including plurality of diodes, the ratio between the different types of secondary optics used with each diode, the alignment angle of each outfitted diode, and the position occupied by each outfitted diode to create different distributions for different applications.

With reference to FIGS. 10*a*-10*c*, each type of secondary optic has at least one prismatic tooth 50, where each tooth has a rear (or reflective) surface 54, a front (or transmissive) surface 56 and a generally triangular cross-section 52 between the surfaces 54 and 56. The rear surface 54 reflects collimated light rays from the collimator 24 which then exits the tooth through the front surface 56 toward a target surface. There is also a connecting surface 58 transverse to the longitudinal axis A, between the primary collimating optic 24 and the secondary optic 26. Selected teeth have also triangular side surface(s) 60 between the surfaces 54 and 56. Advantageously, each "tooth" has a "swept" geometry for better angular (vertical and/or horizontal) control of light rays, where variations between teeth of different types of secondary optics reside in various factors, including plurality of teeth, length of the tooth along the longitudinal axis A, curvature(s) in the vertical and/or horizontal directions, and angularity or tightness of curvature of the swept geometry. To that end, the front and rear surfaces 54, 56 of each tooth can be curved, with selected teeth having surfaces with curvature in more than one direction and/or multiple curvatures in any one direction. These curvatures serve to reflect and direct the light out of the tooth in different spatial distributions, where a milder, more open curvature provides a narrower distribution and a stronger, tighter curvature provides a wider distribution. These curvatures can control the exiting light in both the horizontal and/or vertical directions. The length of a tooth is predetermined to avoid light ray occlusion by adjacent optical members. Whereas the front surface 56 of a tooth is generally parallel with the longitudinal axis of the tooth, the rear surface 54 is slanted or offset from the axis at an angle a measured from the connecting surface 58 such that a light ray incident on the rear surface exits the tooth at an angle ψ (measured from nadir) in general accordance with Equation (6) as follows:

$$90=\alpha+\psi/2 \qquad \text{Eqn (6)}$$

An embodiment of the "high" type of secondary optic 26H is illustrated in FIGS. 15*a*-15*h*. The secondary optic has a solid body with a collimator 24 and a single prismatic portion or tooth 50H. There are two opposing triangular side surfaces 60H between a rectangular rear (reflecting) surface 54H and a rectangular front (exiting) surface 56H. It is understood that because of the curved surfaces of the optics, terms describing polygonal shapes are used loosely throughout herein where, for example, a rectangular shape may be a shape that appears rectangular on a curved surface but its angles or corners do not necessarily measure 90 degrees and its sides may not necessarily be linear. In the illustrated embodiment, each of the front and rear surfaces spans a longer length TH or greater vertical dimension and a lesser width WH or horizontal dimension so that they have a rectangular or "portrait" orientation relative to the longitudinal axis A. The front surface 56H is generally parallel with the longitudinal axis such that angle αH3 is about 90 degrees and the rear surface 54H is offset from the axis A at an angle αH1 from the connecting surface 58. Each of the front and rear surfaces has one or more relatively mild curvatures in at least one direction. In the disclosed embodiment, the front surface 56H has a single mild concave curvature in the horizontal direction, and the rear surface 54H has two mild convex curvature in each of the vertical and horizontal directions of angles αH1 and αH2, where angle αH2 is not equal to αH1. A curved (concave) top front edge 61H is formed where the front surface 56H meets the connecting surface 58H. A curved (convex) top rear edge 63H is formed where the rear surface 54H meets the connecting surface 58H. A curved bottom edge 62H is formed where the front surface 56H and the rear surface 54H meet. Thus, the tooth 50H has an overall curvature or "swept" geometry toward the target surface.

Figure 15A:
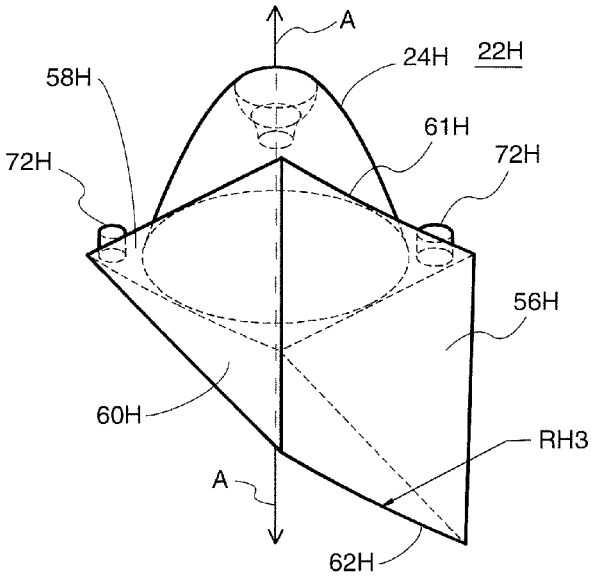
FIG. 15*a* is a bottom isometric view of an embodiment of a "high" optical member in accordance with the present invention.
Figure 15B:
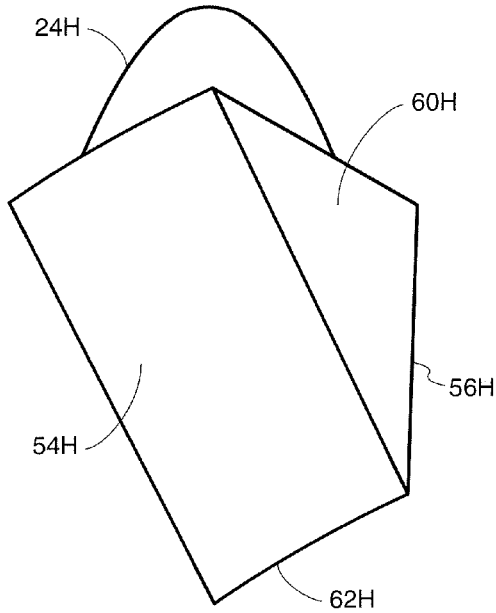
FIG. 15*b* is a rear isometric view of the "high" optical member of FIG. 15*a*.
Figure 15C:
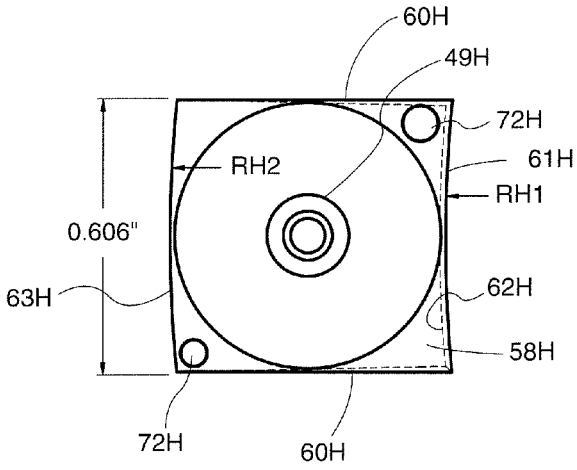
FIG. 15*c* is a top plan view of the "high" optical member of FIG. 15*a*.
Figure 15D:
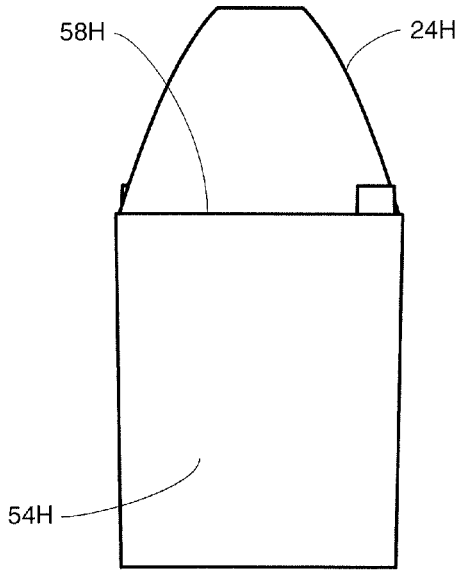
FIG. 15*d* is a rear elevational view of the "high" optical member of FIG. 15*a*.
Figure 15E:
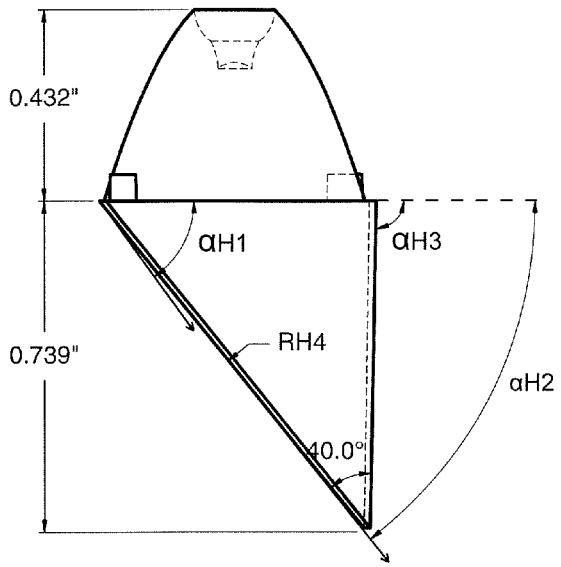
FIG. 15*e* is a side elevational view of the "high" optical member of FIG. 15*a*.
Figure 15F:
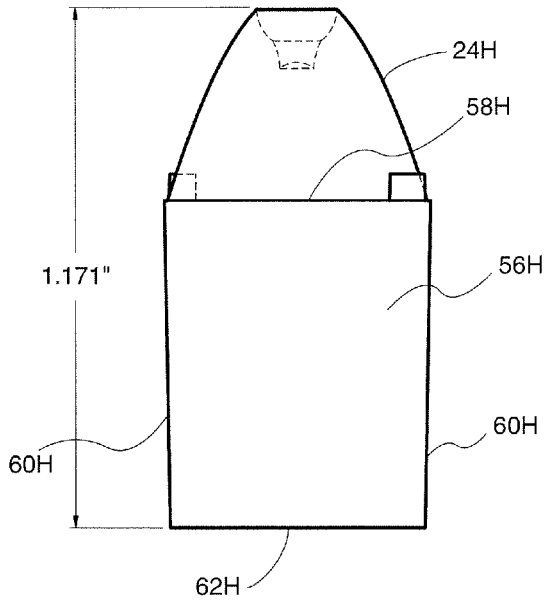
FIG. 15*f* is a front elevational view of the "high" optical member of FIG. 15*a*.
Figure 15G:
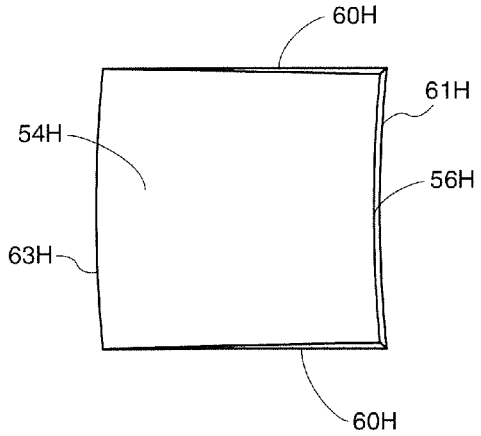
FIG. 15*g* is a bottom plan view of the "high" optical member of FIG. 15*a*.
Figure 15H:
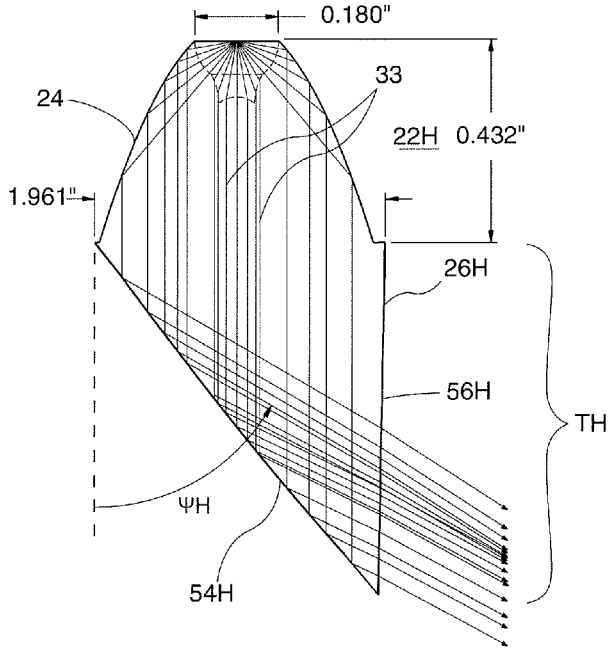
FIG. 15*h* is a side elevational view of the "high" optical member illustrating refraction and total internal reflection of light rays.

As shown in FIG. 15*h*, the collimated rays 33 enter the "high" type secondary optic 26H from the collimator 24, reflect off the rear surface 54H and exit the optical member 22H through the front surface 56H at a predetermined range of vertical angles ψH generally between, e.g., about 60 and 80 degrees. With reference to the illustrated embodiment of the optic 26H in FIG. 15*e*, rays exiting the rear surface 54H have an angle ψH ranging between, e.g., about 77 and 72 degrees, with angle αH1 being about 51.5 degrees and αH2 being about 54 degrees, where angle αH1 is closer to the top rear edge 63H and angle αH2 is closer to the bottom edge 62H. Other dimensions of the disclosed embodiment of the high optic 26H are shown in FIGS. 15*c*, 15*e* and 15*f*, including length TH of about 0.752 inches and width WH of about 0.620 inches. Dimensions shown also include curvature measurements expressed in radius inches where a curvature with R=x inches corresponds to the circumference of a circle with a radius of x inches.

Because the "high" secondary optic 26H throws light at higher vertical angles, the greater length TH of the tooth 50H over teeth of the medium and low optics 26M and 26L serves to prevent occlusion by adjacent optical members 22 in the system 10. In one embodiment, the "high" secondary optic provides a relatively tight and intense beam spanning about 20 degrees generally in the range of vertical angles ψH between about 60-80 degrees. The beam has a horizontal distribution spanning about 20 degrees. This relatively small horizontal beam angle allows the intensity of the beam to be maximized between about 70 and 80 degrees vertical which is optimal for area and surface lighting.

An embodiment of the "medium" type of secondary optic 26M is illustrated in FIGS. 16*a*-16*h*. The secondary optic has a solid body with a collimator and at least two teeth, for example, a first tooth 50Ma and a second tooth 50Mb. The first tooth 50Ma is in the front and closer to the target surface and the second tooth 50Mb is in the rear behind the first tooth and farther from the target surface. Each tooth has a rectangular rear (reflecting) surface 54Ma, 54Mb, a rectangular front (exiting) surface 56Ma, 56Mb, a triangular cross section therebetween, and two triangular side surfaces 60Ma, 60Mb. In the illustrated embodiment, each front surface 56Ma, 56Mb and each rear surface 54Ma, 54Mb has a lesser vertical dimension or length TMa, TMb (where TMa<TMb) and a greater horizontal dimension WMa, WMb (where WMa=WMb), so that they have a "landscape" orientation relative to the vertical or longitudinal axis A. The front surfaces 56Ma, 56Mb are generally parallel with the longitudinal axis A and the rear surfaces 54Ma, 54Mb are tilted or offset from the longitudinal axis at angles αM1, αM2, αM3, αM4. Defined for each tooth are various edges, including top front edges 61Ma, 61Mb, bottom edges 62Ma, 62Mb, and top rear edges 63Ma and 63Mb.

In the disclosed embodiment of the "medium" secondary optic 26M, for the first tooth 50Ma, the front surface 56Ma is generally parallel with the longitudinal axis and has a single horizontal concave curvature. The rear surface 54Ma has both a horizontal convex curvature and a vertical convex curvature. For the second tooth 50Mb, the front surface 56Mb is generally parallel with the longitudinal axis and it has a horizontal concave curvature. The rear surface 54Mb of the second tooth 50Mb has a double horizontal convex curvature, with two identical horizontal convex curvatures that intersect along a vertical centerline forming a cleft 66M. The double horizontal concave curvature aids in horizontal control of the collimated light which is more intense in the center of the secondary optic 26M. The rear surface 54Mb also has two vertical concave curvatures, one closer to the top rear edge 63Mb and the other closer to the bottom edge 62Mb. First and second curved bottom edges 62Ma and 62Mb are formed where respective front and rear surfaces of each tooth meet, both edges being curved toward the target surface. Both of the first and second teeth 50Ma and 50Mb have an overall curvature or a "swept" geometry toward the target.

Each of the first and second teeth of the "medium" secondary optic has a length TMa, TMb in the longitudinal direction that is lesser than the length TH of the tooth 50H of the "high" secondary optic 26H such that TMa<TMb<TH. In one embodiment, TMb is about 0.534 inches and TMa is about 0.295 inches. Each of widths WMa and WMb of the first and second teeth is about 0.600 inches. By providing at least two teeth, one closer to the target surface than the other, the "medium" secondary optic 26M advantageously provides a lower vertical profile which avoids occluding other optical members in the system, especially where the relatively lower angles of throw of the "medium" secondary optics 26M compared to the "high" secondary optics 26H would have otherwise required a much greater vertical length in a single tooth configuration.

Figure 16A:
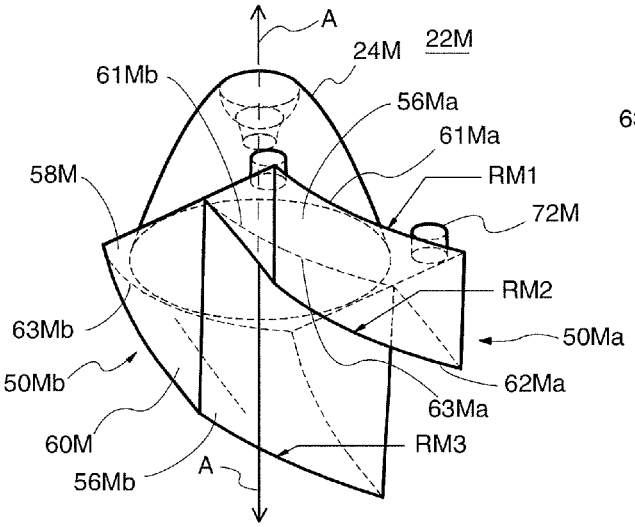
FIG. 16*a* is a front isometric view of an embodiment of a "medium" optical member in accordance with the present invention.
Figure 16B:
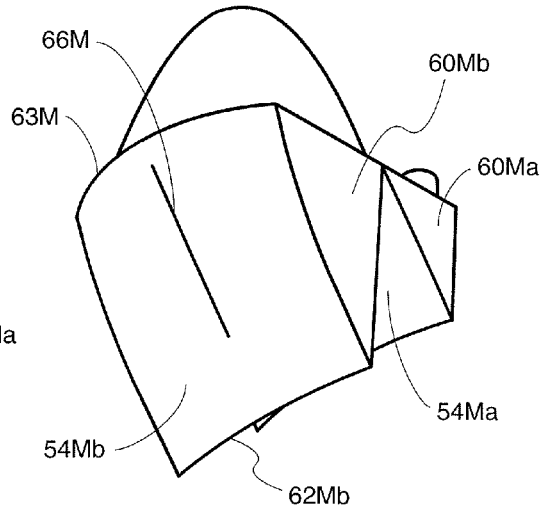
FIG. 16*b* is a rear isometric view of the "medium" optical member of FIG. 16*a*.
Figure 16C:
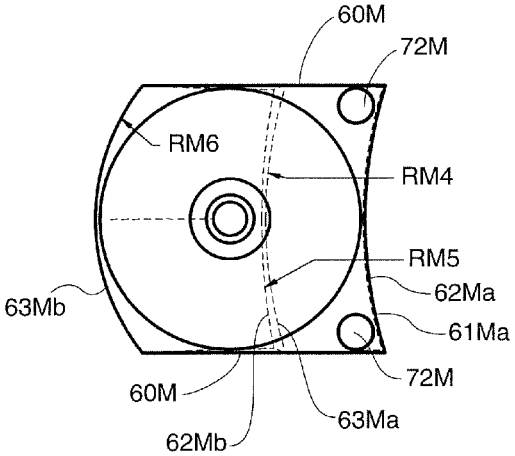
FIG. 16*c* is a top plan view of the "medium" optical member of FIG. 16*a*.
Figure 16D:
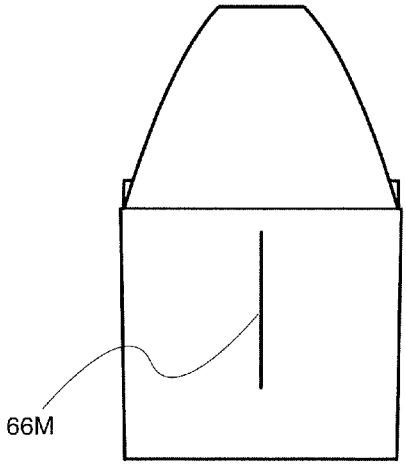
FIG. 16*d* is a rear elevational view of the "medium" optical member of FIG. 16*a*.
Figure 16E:
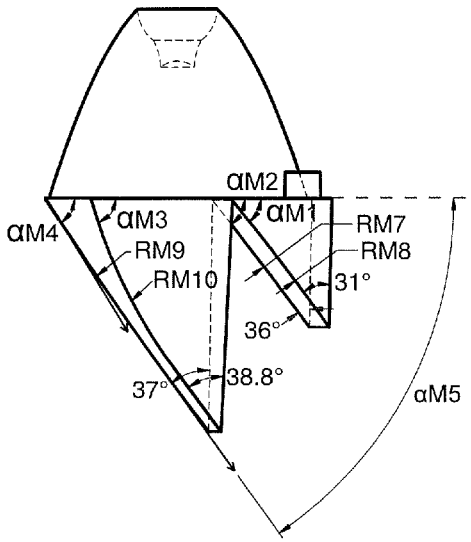
FIG. 16*e* is a side elevational view of the "medium" optical member of FIG. 16*a*.
Figure 16F:
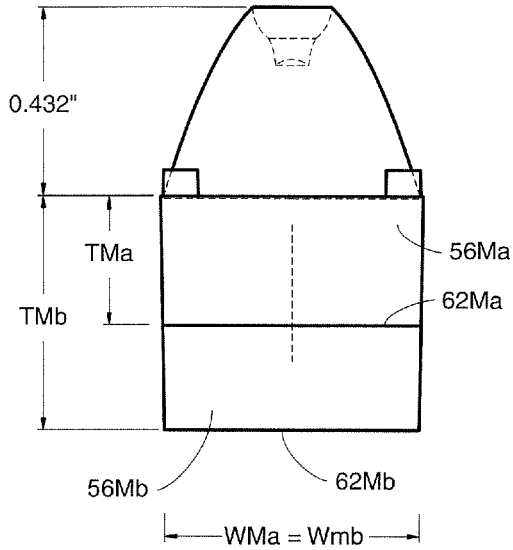
FIG. 16*f* is a front elevational view of the "medium" optical member of FIG. 16*a*.
Figure 16G:
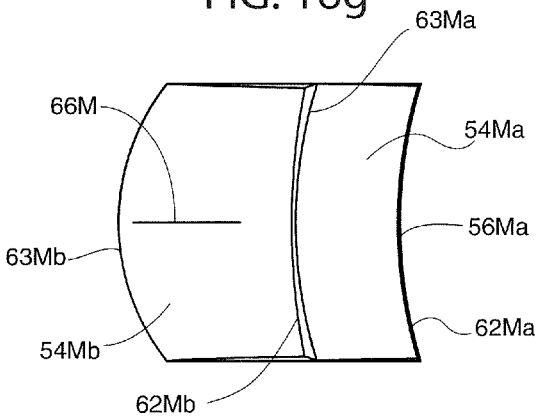
FIG. 16*g* is a bottom plan view of the "medium" optical member of FIG. 16*a*.
Figure 16H:
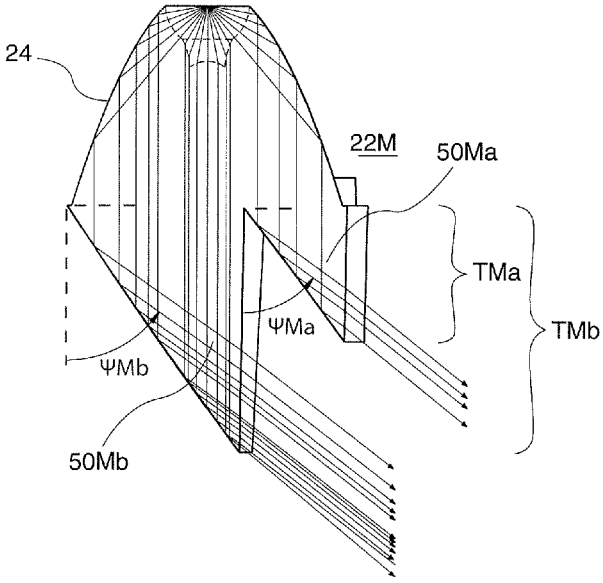
FIG. 16*h* is a side elevational view of the "medium" optical member illustrating refraction and total internal reflection of light rays.

As shown in FIG. 16*h*, the collimated rays 33 from the collimator enter the "medium" type secondary optic 26M, reflect off the rear surfaces 54Ma and 54Mb and exit the optical member 22M through the respective front surfaces 56Ma and 56Mb at predetermined ranges of vertical angles αM generally between, e.g., about 50-70 degrees measured for the first and second teeth. In the disclosed embodiment of the secondary optic 26M, the rays exiting the first tooth 50Ma have an angle ψMa from nadir ranging between about 78 and 74 degrees, with an inner-mid angle αM1 being about 51 degrees and an outer-side angle αM2 being about 53 degrees, and the rays exiting the second tooth 50Mb have an angle ψMb from nadir ranging between about 37 and 67 degrees, with an outer-side angle αM3 being about 71.5 degrees and an inner-mid angle αM4 being about 56.5 degrees. Accordingly, the angle ψ of rear surfaces of each of the front and rear teeth changes along the swept geometry of each tooth in that the triangular cross section between the respective pairs of front and rear surfaces 54Ma, 56Ma, and 54Mb, 56Mb varies within each tooth along the horizontal curvature.

Other dimensions of the disclosed embodiment of the medium optic 26M are shown in FIGS. 16*c*, 16*e* and 16*f*, including length TMa of about 0.295 inches and length TMb of about 0.534 inches. Dimensions shown also include curvature measurements expressed in radius inches where a curvature with R=x inches corresponds to the circumference of a circle with a radius of x inches.

The exiting beam of the "medium" secondary optic has a vertical distribution span of about 10 degrees, ranging between about 55-65 degrees, with a maximum vertical intensity occurring at about 60 degrees, and a horizontal distribution span of about 40 degrees. The "medium" secondary optic 26M provides much less intensity than the "high" secondary optic 26H as it is not intended to target the lower vertical angles but to blend or overlap with edge distribution of the "high" secondary optic 26H.

An embodiment of the third or "low" type of secondary optic 26L is illustrated in FIGS. 17*a*-17*h*. The secondary optic has more than two teeth, for example, four teeth, including a first-fore tooth 50La, a first-aft tooth 50Lb, a second-fore tooth 50Lc and a second-aft tooth 50Ld where both of the second teeth 50Lc and 50Ld stem from a common tooth base 51L. The tooth 50La is closer to the target surface than tooth 50Lb which is closer to the target surface than tooth 50Lc which is closer to the target surface than tooth 50Ld.

The first teeth 50La and 50Lb have front surfaces 56Lc and 56Lb that are generally parallel to the longitudinal axis and these front surfaces have a convex curvature. The first teeth 50La and 50Lb have rear surfaces 54La and 54Lb that are tilted or offset from the longitudinal axis and these rear surfaces have a concave curvature. The second teeth 50Lc and 50Ld have front surfaces 56Lc and 56Ld that are generally parallel to the longitudinal axis. The front surface 56Lc of the second-fore tooth 50Lc is generally flat and planar, but the front surface 56Ld of the second-aft tooth 50Ld has a concave curvature. Rear surfaces 54Lc and 54Ld have a convex curvature.

The first-fore tooth 50La has a concave rear (reflecting) surface 54La with angle αLa, and a convex front (exiting) surface 56La generally parallel with the longitudinal axis A. The first-aft tooth 50Lb has a concave rear (reflecting) surface 54Lb with angle αLb and a convex front (exiting) surface 56Lb generally parallel with the longitudinal axis A. The second-fore tooth has a convex rear surface 54Lc with angle αLc, and a diamond-shaped front surface 56Lc generally parallel with the longitudinal axis A. The second aft tooth has a convex rear surface 54Ld at angle αLd, a front concave surface 56Ld generally parallel with the longitudinal axis A, and two elongated triangular side surfaces 60L. For those surfaces that are rectangular, there is a lesser vertical dimension and a greater horizontal dimension and hence a "landscape" orientation relative to the longitudinal axis.

In the disclosed embodiment of the "low" secondary optic, vertical lengths TL of each tooth increases with distance from the target surface. That is, TLa<TLb<TLc<TLd. A plurality of three or more teeth with such varying lengths advantageously provides the low vertical angle of throw needed for the "low" type of secondary optic while avoiding occlusion. For the first-fore and first-aft teeth 50La, 50Lb, each front surface 56La, 56Lb has a single, generally semi-circular, horizontal convex curvature and each rear surface 54La, 54Lb has a single, generally semi-circular horizontal concave curvature. For the second-fore and second-aft teeth 50Lc, 50Ld, each front surface 56Lc, 56Ld has little or no curvature, and each rear surface 54Lc, 54Ld has a single horizontal convex curvature. Bottom edges 62La and 62Lb of first teeth 50La and 50Lb are semi-circular and curve away from the target source. Bottom edge 62Ld of second aft tooth 50Ld is semi-circular and curves toward the target. Second fore tooth 50Lc has no bottom edge, per se, but only a bottom apex formation 53. Three front surfaces 56La, 56Lb and 56Ld have a radial sweep and the surface 56Lc intersects the longitudinal axis A. Perhaps best see in FIG. 17*g*, front surface 56La of the first fore tooth 50La merges smoothly with an outer circumference of the tooth base 51L to form a full a circular outline. Within this outer circumference are concentric, smaller semi-circular segments of the bottom edges 62Lb and 62Ld. The front teeth 50La, 50Lb have an overall curvature and a swept geometry away from the target surface. However, the rear teeth 50Lc, 50Lc have an overall curvature and a swept geometry toward the target surface.

Figure 17D:
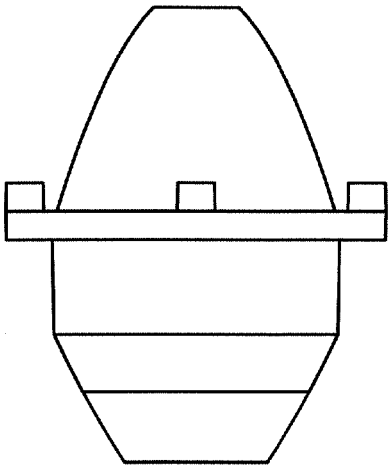
FIG. 17*d* is a rear elevational view of the "low" optical member of FIG. 17*a*.
Figure 17E:
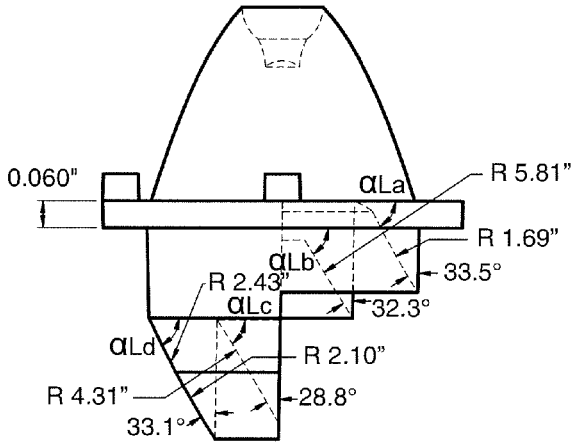
FIG. 17*e* is a side elevational view of the "low" optical member of FIG. 17*a*.
Figure 17F:
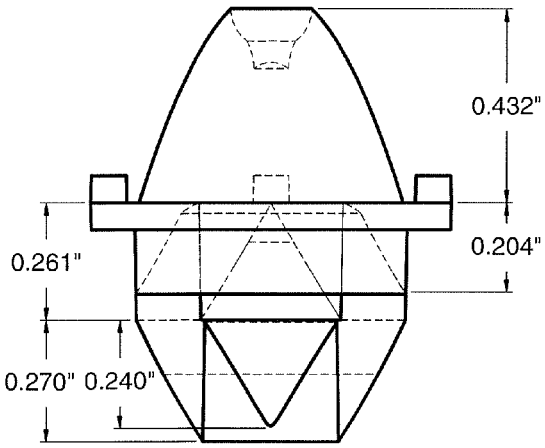
FIG. 17*f* is a front elevational view of the "low" optical member of FIG. 17*a*.
Figure 17G:
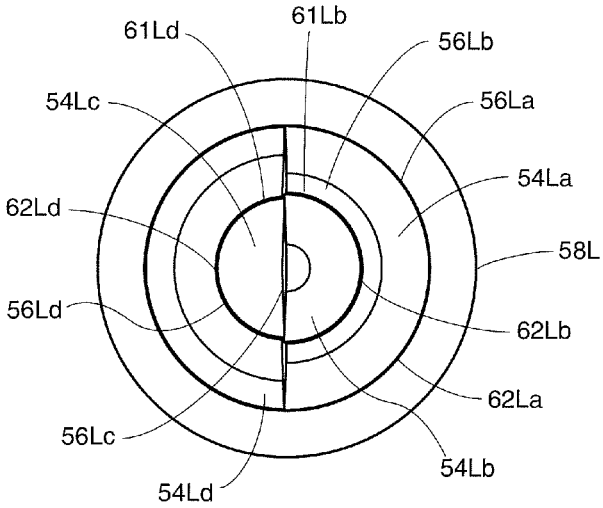
FIG. 17*g* is a bottom plan view of the "low" optical member of FIG. 17*a*.
Figure 17H:
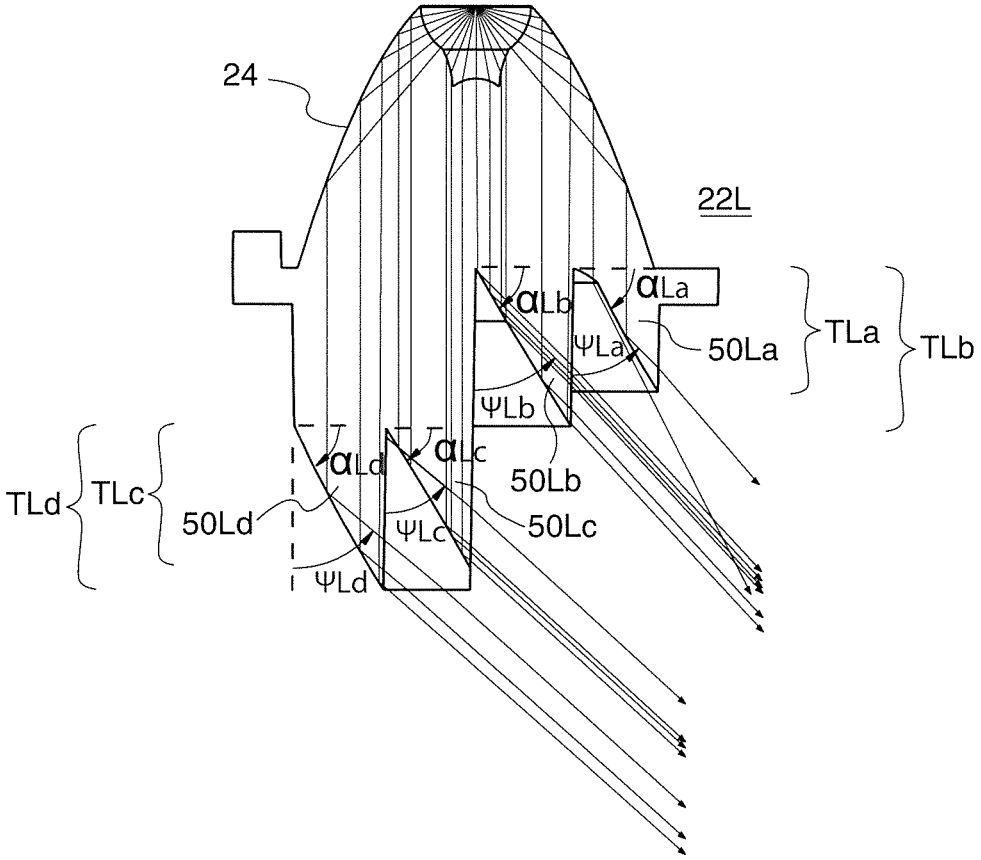
FIG. 17*h* is a side elevational view of the "low" optical member illustrating refraction and total internal reflection of light rays.

As shown in FIG. 17*h*, the collimated rays enter the "low" type secondary optic 26L, reflect off the four rear surfaces 54La-54Ld and exit the optical member 26L through the four front surfaces 56La-56Ld, respectively at predetermined ranges of vertical angles αL generally between, e.g., about 0-50 degrees for the four teeth. In the disclosed embodiment of the secondary optic 26L, the rays exiting the first-fore tooth 50La have an angle ψLa from nadir of about 51 degrees, with angle αLa being about 64.5 degrees. The rays exiting the first-aft tooth 50Lb have an angle ψLb from nadir of about 59 degrees, with angle αLb being about 60.5 degrees. The rays exiting the second-fore tooth 50Lc have an angle ψLc from nadir of about 65 degrees, with angle αLc being about 57.5 degrees. The rays exiting the second-aft tooth 50Ld have an angle ψLd from nadir of about 49.4 degrees, with angle αLd being about 65.3 degrees. Other dimensions of the disclosed embodiment of the low optic 26L are shown in FIGS. 17*a*(2), 17*e* and 17*f*. Dimensions shown also include curvature measurements expressed in radius inches where a curvature with R=x inches corresponds to the circumference of a circle with a radius of x inches.

There is also at least a fifth rear (reflecting) surface 70 best seen in FIG. 17*h* between the first teeth 50La and 50Lb. The surface 70 is considerably smaller than the other front surfaces 56La-56Ld, and has an angle αLe about 33 degrees, where the ray exit angle ψLe is about 114 degrees from nadir allowing for very low vertical angles.

In one embodiment, the exiting beam of the "low" secondary optic 26L has a horizontal distribution span of about 180 degrees and a vertical distribution span generally of about 0 to 55 degrees, with a maximum vertical intensity occurring at about 50 degrees. The "low" secondary optic 26L provides the least intensity between the three types 26H, 26M and 26L described herein. In the disclosed embodiment, the "low" optic 26L is also the type of the least plurality populating the system 10.

Comparing the curvatures of the front and rear teeth surfaces of the three secondary optics 26H, 26M and 26L, the curvatures of the "low" optic 26L are generally more acute or tighter than the curvatures of the "medium" optic 26M which are more acute or tighter than the curvatures of the "high" optic 26H. Comparing the number of teeth of each secondary optic, the "low" optic 26L has a greater plurality of teeth than the "medium" optic 26M which has a greater plurality of teeth than the "high" optic 26H. Comparing the angle a of the tilt or offset of the teeth's rear surfaces from the longitudinal axis, the teeth of the "low" optic 26L generally has the greatest tilt angle which are generally greater than the teeth of the "medium" optic 26M which are generally greater than the tooth of the "high" optic 26H.

The types of secondary optics described herein are intended to work in concert to produce predetermined and relatively concise vertical intensity distributions. It is understood that their horizontal distributions are a matter of overlapping the respective beam spreads using different horizontal aiming angles to produce efficient overall patterns of illumination suitable for a variety of illumination tasks. By having a primary and multiple secondary optics, more precise control over the raw output of an LED diode is possible. Thus, more exacting output light and flexibility in tailoring and scaling output distribution design for specific tasks are possible over conventional systems that use only one primary control, or one primary control with a secondary control.

Regardless of the type of secondary optic used, each optical member 22 has the connecting surface 58 that conveniently provides a flat mounting surface at the junction of the primary collimating optic 24 and the secondary optic 26. Formed on this surface are mounting or alignment members or indicia 72, such as projections, pins and/or alphanumeric symbols, which allow the optical member 22 to be positioned in a predetermined angle or alignment on the alignment plate 18. Within the system 10, each outfitted diode (or "diode optical assembly" comprising a diode 14 and its optical member 22) occupies a unique position and/or holds a unique alignment or angle relative to the target surface, where the outfitted diodes on the alignment plate 18 act in concert to provide the desired illumination pattern on the target surface. As discussed in further detail below, the alignment members 72 allow designated optical members 22 to assume a designated orientation on the alignment plate 18. It is understood that other suitable mounting members include visual indicia, notches, or other mechanical or visual means.

With reference to FIGS. 19*a*-19*i*, the LED plate 12 itself can be rectangular, circular, triangular or any regular or irregular polygonal shape. The plate 12 carries a plurality of diodes 14 arranged in a selected pattern of many possible patterns. The pattern can be a grid pattern as illustrated, a polar pattern or any other pattern. The alignment plate 18 carries at least the plurality of optical members in a pattern that includes at least the selected pattern if not the same selected pattern. The pattern(s) of the plates and/or the optical members 22 are selected based on a number of factors, including parameters of the target surface, e.g., configuration and size, illumination pattern or distribution desired on the target surface, surface location of the luminaire system 10 to illuminate the target surface, and a selected height of the luminaire. Based on these factors, the alignment of each optical member 22 on the alignment plate 18 is determined, for example, by manual trial-and-error and/or mathematical algorithms implemented by a microprocessor, for the selected pattern of diodes on the LED plate 12. To align each optical member 22 accordingly, matching indicia are provided on the alignment plate 18 and each optical member 22.

In the disclosed embodiment, the alignment members 72 are formed on each optical member 22 on the connecting surface 58 facing the collimator 24, because the connecting surface 58 interfaces with the alignment plate 18. Each type of optical member 22H, 22M, 22L has a unique identifying plurality and/or pattern of alignment member(s). In the disclosed embodiment, the high optical member 22H has two single pins 72 on specific corners of the generally square connecting surface 58, for example, the front right corner and the rear left corner when viewed from the front surfaces 56H of the optic (FIG. 15*c*). For the medium optical member 22L, there are two pins 72 on specific corners of the generally square connecting surface 58, for example, the front left and front right corners when viewed from the front surfaces 56Ma, 56Mb (FIG. 16*c*). For the low optical member 22L, there are three pins 72 on the circular connecting surface 58, for example, at 0, 90 and 270 degrees when viewed from the front surfaces 56La, 56Lb, 56Lc and 56Ld. It is understood that there are limitless number of possible identifying patterns, so long as each type of optical member has a unique or distinguishing pattern by which it is identified.

Corresponding to these plurality and patterns of alignment pins 72, the alignment plate provides matching openings or through-holes 73 adjacent the holes 23 in which the optical members 22 are received and mounted. As shown in FIG. 18, the pin 72 inserted in the holes 23 are visible on the rear surface 30, along with the primary optic 24 of each optical member 22, although it is understood that the pins 72 need not extend completely through the alignment plate 18 to serve as alignment members. In the illustrated embodiment, the alignment angle θ shown for each diode provides the system with lateral symmetry about a centerline, which is typical of most lighting systems. However, the system can be readily configured to provide radial symmetry and/or any asymmetrical pattern by varying the angle θ and/or the combination of optics.

Each optical member 22 is mechanically mounted or attached to the alignment plate 18, for example, by insertion through the opening 23 formed in the alignment plate 18 at the member's designated position, and then affixation by fasteners, wires, adhesives and/or other means. Advantageously, this manner of construction and assembly provides several advantages including (1) the alignment plate 18 can be manufactured separately from the LED plate 12 and (2) each LED plate 12 may be used with a plurality of populated alignment plate 18, each of which can present a unique combination of optical members (installed according to the patterns of alignment member holes 73 surrounding each optical member hole 23) to provide a different illumination pattern or distribution on a target surface.

Figure 20:
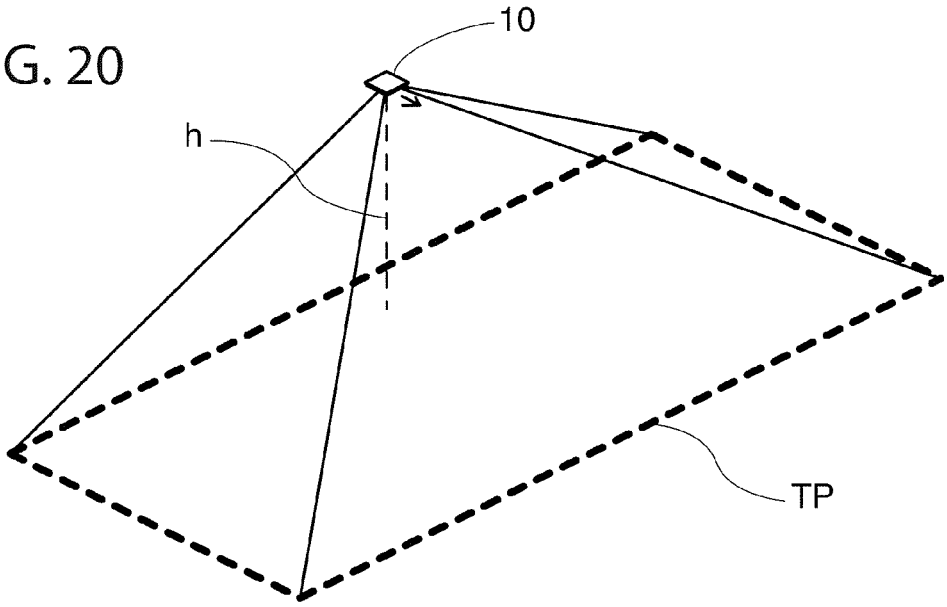
FIG. 20 is a schematic of an LED optical system of the present invention illuminating a target surface from a vertical distance of h.

The populated alignment plate 18 is then attached mechanically to the populated LED plate 12 (FIG. 5). As shown in FIG. 20, the system 10 is intended to illuminate a target plane TP from a location X above the target plane at a distance h, where the plates 12 and 18 are generally parallel to the target plane. As shown in FIGS. 21*a*-21*h*, the target plane can be rectangular, square, triangular or circular. Regardless of the shape or size of the target plane, different combinations of individual iso-illuminance lines B from each diode optical assembly (comprising a diode and its optical member) of a system 10 can be provided to illuminate a target plane with the desired illumination or distribution, including a distribution that serves well in mimicking a Lambertian distribution, at any location on the target plane. The different types of secondary optical members can be distinguished by the "salmon-like" iso-illuminance lines $B_H$ of the high secondary optic 26H, the "cardioid-like" iso-illuminance lines $B_M$ of the medium secondary optic 26M and the oval iso-illuminance lines $B_L$ of the low secondary optic 26L. By aligning optical members to provide overlaps and blending 80 between adjacent iso-illuminance lines of same or different types of secondary optics, the system 10 uniformly and efficiently illuminate the area of the target plane TP. Each diode optical assembly illuminates a portion of the overall area on the target plane and allows the system 10 as a whole to produce very little waste light.

Examples of different patterns of illuminations, or distributions are shown in FIGS. 21*a*-21*h*. It is understood that the pattern may vary infinitely depending on the needed distribution pattern. To vary the pattern, a different combination of secondary optics 26H, 26M and 26L and unique individual alignments are used. This results in a unique alignment plate 18, but does not necessarily alter the LED array 12 itself, which is advantageous for manufacturing purposes.

In typical "area lighting" applications, a variety of distribution patterns in different locations are needed to efficiently light large areas around building sites, parking lot, or any place that needs illumination for use or architectural lighting. These applications are not limited to outdoor light and can also be used to efficiently light interior surfaces or areas as well as well as objects and building facades.

Figure 21A:
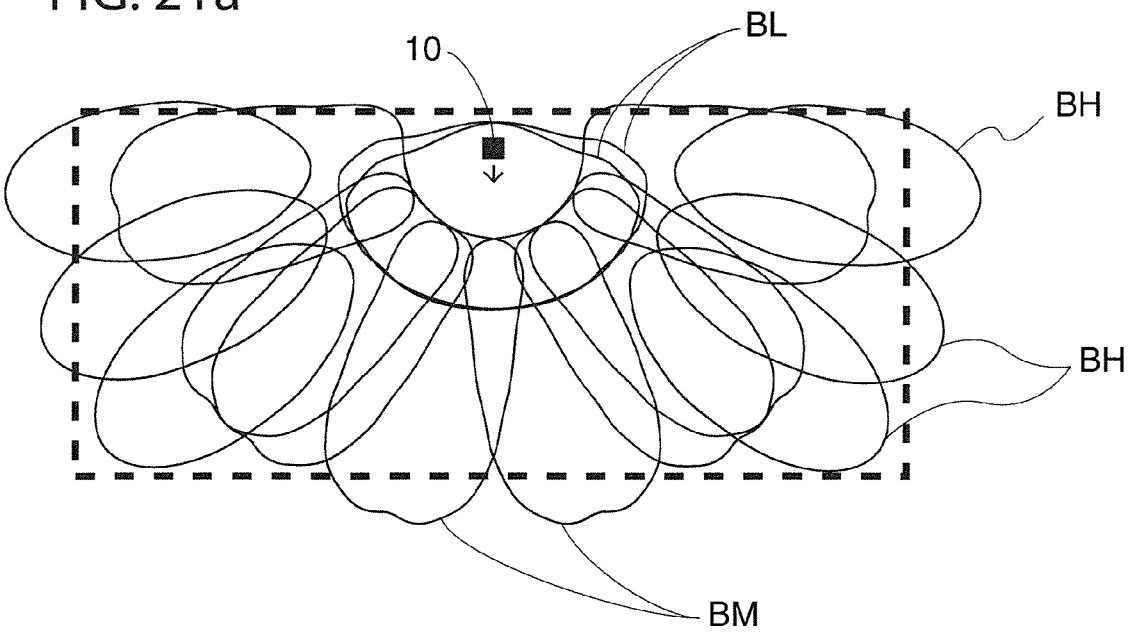
FIGS. 21*a*-21*h* are plan views of various overlapping illumination patterns provided by LED optical systems in accordance with the present invention.
Figure 21B:
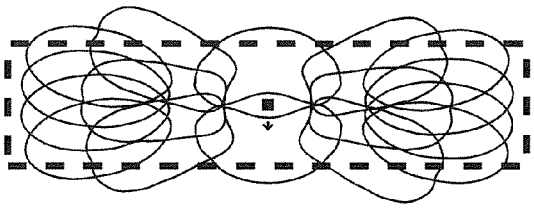
Figure 21C:
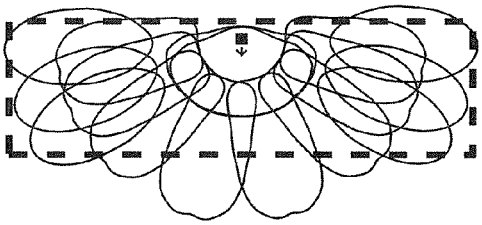
Figure 21D:
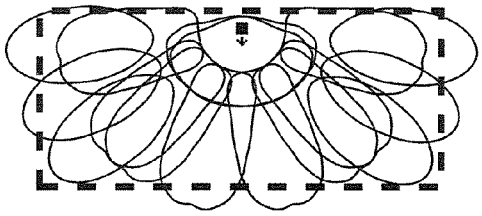
Figure 21E:
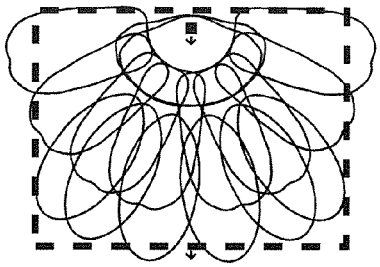
Figure 21F:
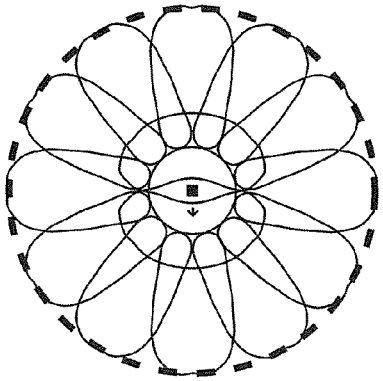
Figure 21G:
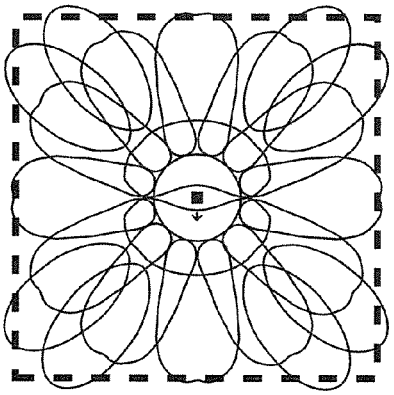
Figure 21H:
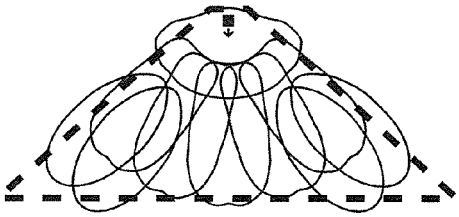

Flexibility is also gained from the system as the plates 12 and 18 can assume any configuration. The system came be housed in an enclosure with the necessary electrical and mechanical components to provide a more complete luminaire. A lens may also be used to protect the system from outdoor exposure. Luminaires can vary in shape by using the system to a greater extent than is previously possible with many standard light sources. It is understood that the system as a whole is scalable. As illustrated in FIGS. 21*a* and 21*g*-21*h*, a system with a "square" configuration can be scaled up to produce more light over an area by increasing the plurality of the diodes and optical members within the system. In effect, because each coupled diode and optical member operates independently, these same coupled components can be used in a larger system. Again, this adds flexibility to the system.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A lighting system, comprising:

a plurality of light emitting diodes; and an optical member for each diode;

wherein each optical member comprises a primary optic and a secondary optic, and wherein each primary optic comprises a collimator configured to collect light rays from its respective diode and emit the light rays in a direction substantially parallel to a longitudinal axis of the respective diode, the light rays exiting the collimator toward its respective secondary optic, and each secondary optic comprises a prismatic optic selected from the prismatic optic group consisting of a high optic, a medium optic and a low optic.

2. A lighting system of claim 1, further comprising:

a first plate member on which the diodes are mounted; and a second plate member on which the optical members are mounted.

3. A lighting system of claim 1, wherein the high optic has one prismatic portion.

4. A lighting system of claim 1, wherein the medium optic has two prismatic portions.

5. A lighting system of claim 1, wherein the low optic has at least three prismatic portions.

6. A lighting system of claim 2, wherein each optical member includes at least one alignment member adapted to align the member on the second plate member.

7. A lighting system, comprising:

a first support member and a second support member having a forward surface and a rearward surface;

a plurality of light emitting diodes mounted on the first support member; and a plurality of optical members mounted on the second support member, wherein the first and second support members are arranged such that each diode is optically coupled to a respective optical member, and each optical member comprises a primary optic mounted on the rearward surface of the second support member and a secondary optic mounted on the forward surface of the second support member, and wherein each primary optic comprises a collimator configured to collect light rays from its respective diode and emit the light rays in a direction substantially parallel to a longitudinal axis of the respective diode, the light rays exiting the collimator toward its respective secondary optic, and each secondary optic comprises an optic selected from the optic group consisting of a high optic, a medium optic and a low optic.

8. A lighting system of claim 7, wherein the optic has at least one prismatic portion.

9. A lighting system of claim 7, wherein the high optic has at least one prismatic portion.

10. A lighting system of claim 7, wherein the medium optic has at least two prismatic portions.

11. A lighting system of claim 7, wherein low optic has at least three prismatic portions.

12. A lighting system of claim 7, wherein the low optic has at least four prismatic portions.

13. A lighting system of claim 7, wherein the low optic provides an iso-illuminance line having a generally salinon configuration.

14. A lighting system of claim 7, wherein the medium optic provides an iso-illuminance line having a generally cardioid configuration.

15. A lighting system of claim 7, wherein the high optic provides an iso-illuminance line having an oval configuration.

16. A lighting system of claim 7, wherein each optical member has at least one alignment member adapted to indicate an alignment position on the second support member.

17. A lighting system of claim 7, wherein optical members of different optics have different plurality of alignment members.

18. A lighting system of claim 7, wherein optical members of different optics have different pattern of alignment members.

19. A lighting system for illuminating a target surface, comprising:

a plurality of light emitting diodes mounted on a first plate, and a plurality of optical members mounted on second plate of a structure, the structure further defining a nadir relative to the target surface, wherein each optical member is adapted to receive light rays of a respective diode, and each optical member comprises:

a primary optic situated on a rearward surface of the second plate and configured to collimate the light rays in a direction substantially parallel to a longitudinal axis of the respective diode, the light rays exiting the primary optic toward its respective secondary optic, and a secondary optic situated on a forward surface of the second plate and configured to redirect the light rays, the secondary optic being selected from the secondary optic group consisting of a high secondary optic, a medium secondary optic and a low secondary optic, wherein the high secondary optic redirects the light rays to angles ranging between about 60 to 80 degrees from nadir, the medium secondary optic redirects the light rays to angles ranging between about 50 to 70 degrees from nadir, and the low secondary optic redirecting the light rays to angles ranging between about 0 to 50 degrees from nadir.

20. A lighting system of claim 19, wherein, the low secondary optic has more than two prismatic teeth.

21. A lighting system of claim 19, wherein the medium secondary optic has at least two prismatic teeth.

22. A lighting system of claim 19, wherein the high secondary optic has a single prismatic teeth.

* * * * *

UNITED STATES PATENT AND TRADEMARK OFFICE

CERTIFICATE OF CORRECTION

PATENT NO. : 8,662,704 B2
APPLICATION NO. : 12/851319
DATED : March 4, 2014
INVENTOR(S) : Timothy Carraher et al.

It is certified that error appears in the above-identified patent and that said Letters Patent is hereby corrected as shown below:

In the Claims

| | |
|---|---|
| Column 19, line 7, Claim 11 | After "wherein"<br>Insert -- the -- |
| Column 19, line 32, Claim 19 | After "on"<br>Insert -- the -- |
| Column 20, line 29, Claim 22 | Delete "teeth"<br>Insert -- tooth -- |

Signed and Sealed this
Ninth Day of February, 2016

Michelle K. Lee

Michelle K. Lee
*Director of the United States Patent and Trademark Office*